US012435905B2

(12) United States Patent
Choi et al.

(10) Patent No.: US 12,435,905 B2
(45) Date of Patent: Oct. 7, 2025

(54) AIR CONDITIONER AND INSTALLATION KIT

(71) Applicant: LG ELECTRONICS INC., Seoul (KR)

(72) Inventors: Sungsik Choi, Seoul (KR); Hongseung Do, Seoul (KR); Pyo Sagong, Seoul (KR); Yejin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 197 days.

(21) Appl. No.: 18/196,331

(22) Filed: May 11, 2023

(65) Prior Publication Data

US 2023/0366588 A1 Nov. 16, 2023

(30) Foreign Application Priority Data

May 13, 2022 (KR) ..... 10-2022-0058735

(51) Int. Cl.
*F24F 13/32* (2006.01)
*F24F 1/031* (2019.01)

(52) U.S. Cl.
CPC ..... *F24F 13/32* (2013.01); *F24F 1/031* (2019.02); *F24F 2221/20* (2013.01)

(58) Field of Classification Search
CPC .. F24F 13/32; F24F 13/20; F24F 1/031; F24F 1/027; F24F 2221/20; E06B 7/02
See application file for complete search history.

(56) References Cited

U.S. PATENT DOCUMENTS

2021/0237405 A1* 8/2021 Weiss ..... F24F 1/031

FOREIGN PATENT DOCUMENTS

| | | | | |
|---|---|---|---|---|
| CN | 108119962 A | * | 6/2018 | ..... E06B 7/28 |
| JP | 2005-024125 | | 1/2005 | |
| JP | 2005024125 A | * | 1/2005 | |
| KR | 10-2020-0135085 | | 12/2020 | |
| KR | 20200135085 A | * | 12/2020 | ..... F24F 13/0254 |
| KR | 20210136733 A | * | 11/2021 | ..... F24F 13/0254 |

OTHER PUBLICATIONS

Korean Office Action dated Nov. 23, 2023 issued in Korean Application No. 10-2022-0058735.

* cited by examiner

*Primary Examiner* — Emmanuel E Duke
(74) *Attorney, Agent, or Firm* — KED & ASSOCIATES, LLP

(57) ABSTRACT

An installation kit according to an embodiment includes a front panel having an opening, into which an air conditioner disposed between a window frame and a window is inserted, and extending vertically to be coupled to the window frame on an indoor side of a space in which the air conditioner is disposed, wherein the front panel includes: a plate coupled to the window frame and extending vertically; a plurality of cutting plates arranged vertically and disposed to be detachable from the plate; and a cutting groove recessed into the plate and formed between the plurality of cutting plates, such that a vertical height of the installation kit may be easily adjusted.

21 Claims, 28 Drawing Sheets

AIR CONDITIONER AND INSTALLATION KIT

CROSS-REFERENCE TO RELATED APPLICATION(S)

This application claims priority under 35 U.S.C. § 119 to Korean Application No. 10-2022-0058735 filed in Korea on May 13, 2022, whose entire disclosure is hereby incorporated by reference. This application is also related to U.S. patent application Ser. No. 18/196,277 filed on May 11, 2023, whose entire disclosure is also hereby incorporated by reference.

BACKGROUND

1. Field

An air conditioner and an installation kit are disclosed herein.

2. BACKGROUND

An air conditioner is a device for supplying conditioned air to an indoor space by cooling, heating, or purifying intake air. A window-mounted air conditioner is mounted between a window frame and a window and supplies conditioned air to an indoor space. The window-mounted air conditioner typically includes an inlet and an outlet which are open toward the indoor space, and an outer surface opposite to the outlet and that faces the outside.

A separate installation frame for supporting the air conditioner may be installed at the window and the window frame. However, a window-mounted air conditioner typically do not include a separate finishing member that is provided at a front of the installation frame, such that noise and vibration generated by the air conditioner may be transmitted to the indoor space, and rainwater may enter from the outside and flow into the indoor space. In addition, a height of a known installation frame typically cannot be adjusted according to a window size, such that a gap is formed between the frame, the window, and the window frame, thereby degrading sealing and insulation performance of the frame. Furthermore, known installation are typically difficult to install in a window frame, typically include various types of components, and typically have require a complicated assembly of the components.

BRIEF DESCRIPTION OF THE DRAWINGS

Embodiments will be described in detail with reference to the following drawings in which like reference numerals refer to like elements, and wherein.

DETAILED DESCRIPTION

Figure 1:
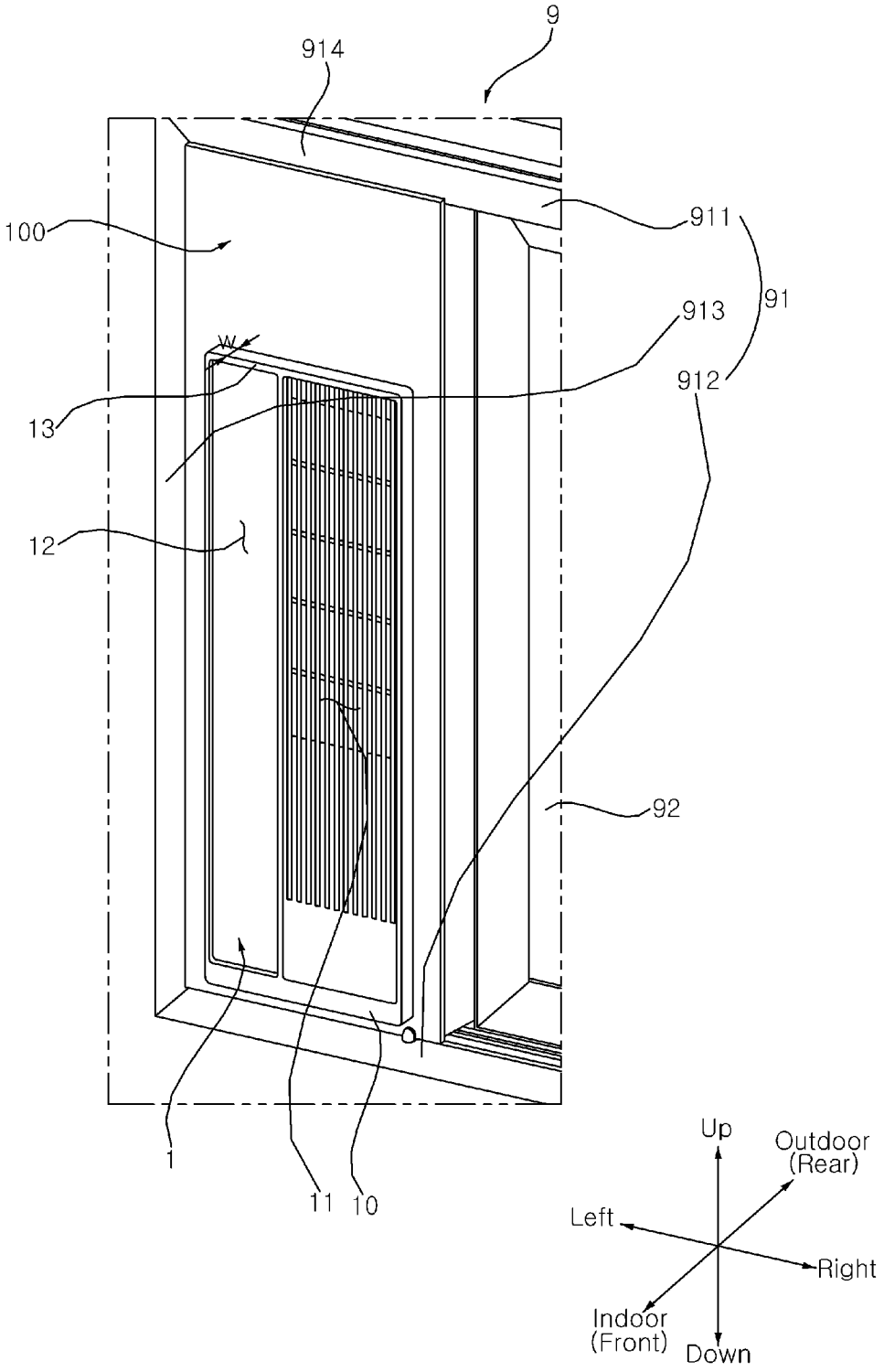
FIG. 1 is a diagram illustrating an air conditioner and an installation kit which are installed in a window according to an embodiment of the present disclosure.

Hereinafter, the present disclosure will be described in detail with reference to the accompanying drawings, in which the same reference numerals are used throughout the drawings to designate the same or similar components, and a redundant description thereof will be omitted. It will be noted that a detailed description of known arts will be omitted if it is determined that the detailed description of the known arts can obscure the embodiments of the invention. Further, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

The terms "module" and "unit" for elements used in the following description should be defined simply in view of the ease of the description, and do not have a distinguishing meaning or role. Furthermore, it should be understood that, although the terms first, second, etc., may be used herein to describe various elements, these elements should not be limited by these terms, and these terms are only used to distinguish one element from another. Additionally, it should be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the singular forms are intended to include the plural forms as well, unless the context clearly indicates otherwise.

Referring to FIG. 1, an air conditioner 1 and an installation kit 100 will be described below. FIG. 1 is a diagram illustrating a state in which the air conditioner 1 is installed in a window assembly 9. The window assembly 9 may include a window frame 91 and a window 92. The window 92 may be movably mounted on the window frame 91.

The window frame 91 may include an upper support 911. The window 92 may be coupled to the upper support 911 so as to be movable in a horizontal direction. The air conditioner 1 may be disposed below the upper support 911. The installation kit 100 may be disposed on a lower side of the upper support 911.

The window frame 91 may include a lower support 912. The window 92 may be coupled to the lower support 912 so as to be movable in the horizontal direction. The air conditioner 1 may be disposed above the lower support 912. The installation kit 100 may be disposed on an upper side of the lower support 912.

The air conditioner 1 may be disposed between the upper support 911 and the lower support 912. The window 92 may be disposed between the upper support 911 and the lower support 912. The installation kit 100 may be disposed between the upper support 911 and the lower support 912.

The window frame 91 may include a side support 913. The window 92 may move horizontally to be mounted on the side support 913. The air conditioner 1 may be disposed between the window 92 and the side support 913. The installation kit 100 may be disposed between the window 92 and the side support 913.

The air conditioner 1 may include a case 10. Components for operating the air conditioner 1 may be disposed in the case 10. The air conditioner 1 may have an inlet 11. The air conditioner 1 may include an outlet 12. The inlet 11 and the outlet 12 may be formed in a surface facing an indoor space. The inlet 11 and the outlet 12 may be open toward the indoor space in the case 10.

The installation kit 100 may be disposed between the window frame 91 and the window 92. The case 10 of the air conditioner 1 may be supported by the installation kit 100. The installation kit 100 may be disposed to surround the case 10.

The window frame 91 may include a window frame front end 914. The window frame front end 914 may refer to one side of the window frame 91 facing the indoor space. The window frame front end 914 may be disposed to face the indoor space. The installation kit 100 may be coupled to the window frame front end 914. The installation kit 100 may be fixed to the window frame front end 914. The installation kit 100 may be disposed to face the indoor space.

The case 10 may include a case front end 13. The case front end 13 may refer to one side of the case 10 facing the indoor space, and the case front end 13 may be disposed to face the indoor space. The installation kit 100 may be disposed to surround the case front end 13. The installation kit 100 may support a front end of the air conditioner 1. The case front end 13 may protrude further forward than the window frame front end 914. A front edge of the case front end 13 may protrude further toward the indoor space than a front edge of the window frame front end 914.

The case front end 13 may protrude further forward than a front surface of the installation kit 100. The front edge of the case front end 13 may protrude further toward the indoor space than a front surface of the front panel 110 (see FIG. 3). A gap w in a front-rear direction may be formed between the case front end 13 and the installation kit 100.

The installation kit 100 may be made of a same material or type of material as the case 10. The installation kit 100 and the case 10 may have a same color or coordinating colors. Alternatively, the front panel 100 (see FIG. 3) may be made of the same material as the case front end 13. The front panel 110 (see FIG. 3) may have the same color as the case front end 13. Accordingly, friction between the installation kit 100 and the case 10 may be minimized, the appearance may be improved, a manufacturing process may be simplified, production costs may be reduced, and noise and vibration generated in the case 10 may be reduced.

Figure 2:
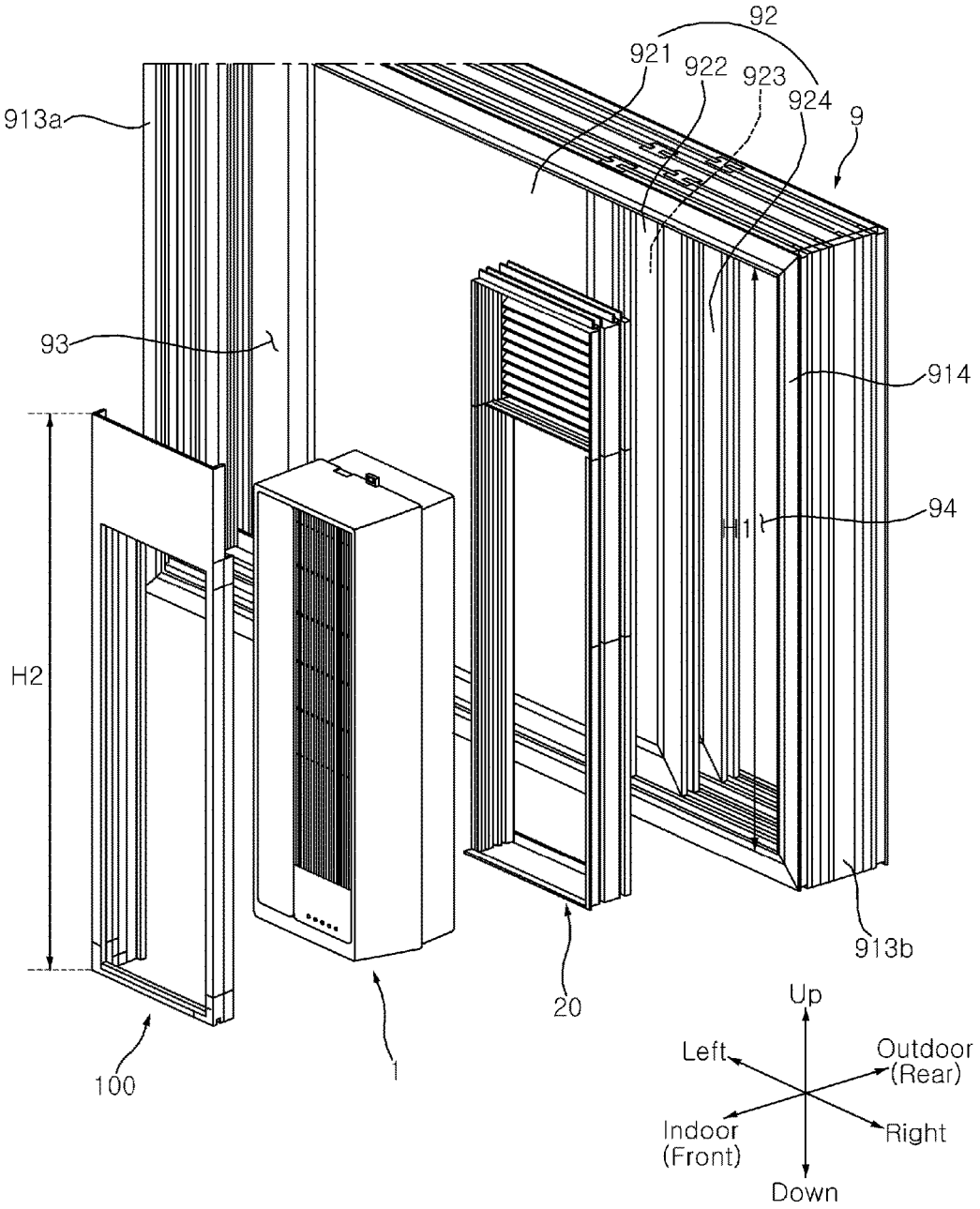
FIG. 2 is an exploded view of an air conditioner and an installation kit according to an embodiment of the present disclosure.

Referring to FIG. 2, the air conditioner 1 and the installation kit 100 will be described below. FIG. 2 is an exploded view of the air conditioner 1 and the installation kit 100 which are installed in the window assembly 9.

The installation kit 100 may include an installation frame 20. The installation frame 20 may be disposed between the window frame 91 and the window 92. The installation frame 20 may be fixed to the window frame 91. The installation frame 20 may provide a space in which the air conditioner 1 is disposed.

Figure 3:
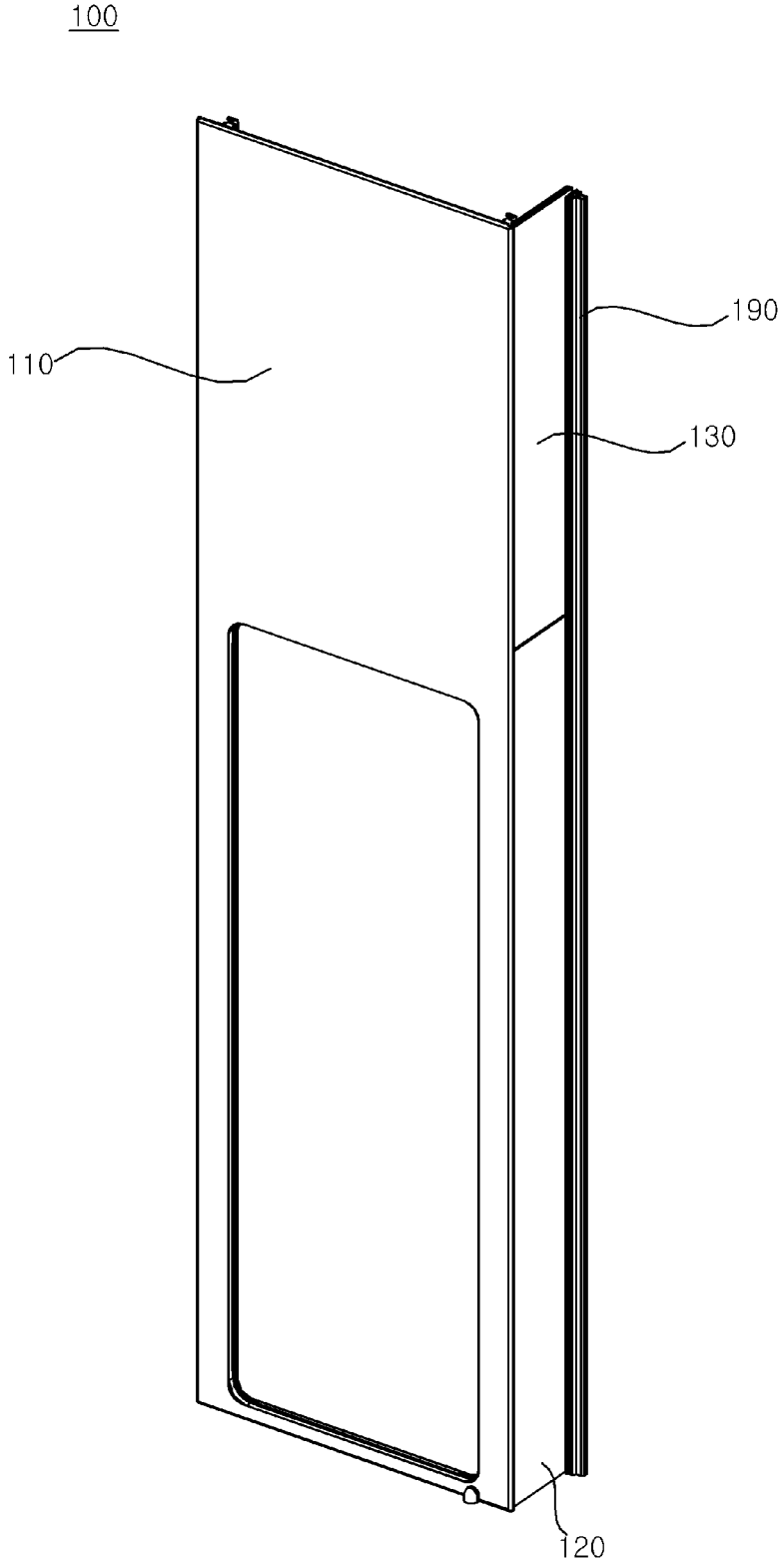
FIG. 3 is a perspective view of an installation kit according to an embodiment of the present disclosure.

The installation frame 20 may be disposed at the rear of the front panel 110 (see FIG. 3). The installation frame 20 may be installed in the window assembly 9 separately from the front panel 110. After installing the installation frame 20 and the air conditioner 1 in the window assembly 9, a user may install an assembly of the installation kit 100, including the front panel 110, at the front of the installation frame 20.

The side support 913 of window frame 91 may include a first side support (or left side support) 913*a* and a second side support (or right side support) 913*b*. The first side support 913*a* and the second side support 913*b* may be horizontally spaced apart from each other. The window 92 may be disposed between the first side support 913*a* and the second side support 913*b*. The window 92, disposed between the first side support 913*a* and the second side support 913*b*, may move horizontally along the upper support 911 (see FIG. 1) and the lower support 912 (see FIG. 1).

There may be a plurality of windows 92. The plurality of windows 92 may be spaced apart from each other in a direction from the inside to the outside. The plurality of windows 92 may be spaced apart from each other in a front-rear direction. In one example, the plurality of windows 92 may include a first window 921, a second window 922, a third window 923, and a fourth window 924. The first to fourth windows 921, 922, 923, and 924 may be divided into the first window 921, the second window 922, the third window 923, and the fourth window 924 in order of proximity to the indoor space. However, the number and names of the plurality of windows 92 are not limited to the above example. For example, in the case where the window assembly 9 is a double window, the plurality of windows 92 may include the first to fourth windows 921, 922, 923, and 924. For example, if the window assembly 9 is a single window, the plurality of windows 92 may include the first and second windows 921 and 922.

The installation kit 100 and 1000 may be disposed between at least one of the plurality of windows 92 and the side support 913. The installation frame 20 may be disposed between at least one of the plurality of windows 92 and the side support 913. Installation kits 100 and 1000 may be installed for both the single window and the double window. For example, if the window assembly 9 is the double window system, the installation kit 100, to be described with reference to FIGS. 1 to 21, may be installed in the window assembly 9. In another example, if the window assembly 9 is the single window system, the installation kit 1000, to be described with reference to FIGS. 22 to 28, may be installed in the window assembly 9.

The window assembly 9 may provide a plurality of spaces 93 and 94 in which the air conditioner 1 may be installed. The spaces 93 and 94 may be formed between the first side support 913*a* and the second side support 913*b*. For example, the installation kit 100 may be installed in first space (or left space) 93. The first space 93 may be formed between the first side support 913*a* and the window 92. In another example, the installation kit 100 may be installed in second space (or right space) 94. The second space 94 may be formed between the second side support 913*b* and the window 92.

The first space 93 and the second space 94 may be horizontally spaced apart from each other. A user may selectively install the air conditioner 1 and the installation kit 100 in the first space 93 or the second space 94. The user may selectively install the installation kit 100 in either of the first space 93 and the second space 94 by adjusting positions of components 120, 130, 140, and 150 (see FIG. 4) of the installation kit 100, as will be described below.

A vertical height H2 of the installation kit 100 may vary according to a height H1 of the window assembly 9. The first space 93 and the second space 94 may have the vertical height H1. The height H1 of the first space 93 and the second space 94 may be standardized. The vertical height H2 of the installation kit 100 may be adjusted according to the height H1 of the first space 93 and the second space 94. The height H2 of the installation kit 100 may be greater than the height H2 of the first space 93 and the second space 94.

Figure 4:
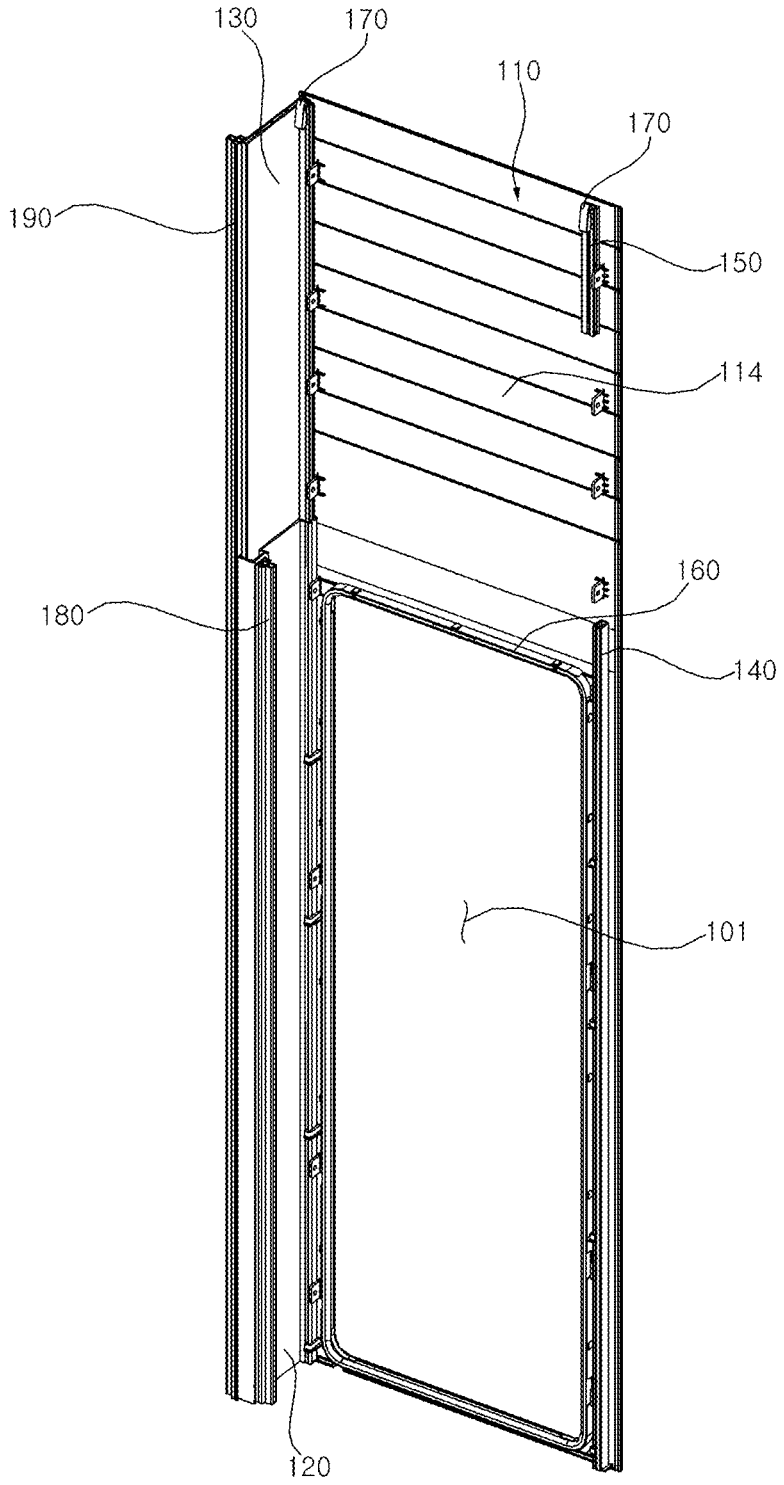
FIG. 4 is a perspective view of an installation kit according to an embodiment of the present disclosure.

Referring to FIGS. 3 and 4, the installation kit 100 will be described below. FIG. 3 is a diagram illustrating the installation kit 100 as viewed from the front. FIG. 4 is a diagram illustrating the installation kit 100 as viewed from the rear.

The installation kit 100 may include the front panel 110. The front panel 110 may be disposed to surround the case front end 13 (see FIG. 1) of the air conditioner 1 when received in the first space 93 (see FIG. 2) or the second space 94 (see FIG. 2).

The installation kit 100 may have an opening 101. The case 10 of the air conditioner 1 may pass through the opening 101. The case 10 may be supported by the installation kit 100 in the opening 101. The opening 101 may be formed in the front panel 110.

The installation kit 100 may include a first side frame (or window facing side frame) 120. The first side frame 120 may be coupled to and detached from the front panel 110. For example, the first side frame 120 may be disposed at a rear surface of the front panel 110. The first side frame 120 may extend in an up and down or vertical direction when installed on the front panel 110. A vertical length of the first side frame 120 may be smaller than a vertical length of the front panel 110. The first side frame 120 may be referred to as a "side frame." The side frame may collectively include a first side frame 120 and a second side frame 140.

The installation kit 100 may include an extension frame 130. The extension frame 130 may be coupled to and detached from the front panel 110. The extension frame 130 may be disposed at a rear surface of the front panel 110. The extension frame 130 may extend in the vertical direction. A vertical length of the extension frame 130 may be smaller than the vertical length of the front panel 110. The extension frame 130 may be coupled to the first side frame 120 so as to be movable in the vertical direction.

The installation kit 100 may include the second side frame (or window-frame facing side frame) 140. The second side frame 140 may be coupled to and detached from the front panel 110. The second side frame 140 may be disposed at a rear surface of the front panel 110. The second side frame 140 may extend in the vertical direction. A vertical length of the second side frame 140 may be smaller than the vertical length of the front panel 110. A front-to-back width of the second side frame 140 may be smaller than a front-to-back width of the first side frame 120.

The first side frame 120 and the second side frame 140 may be horizontally spaced apart from each other. The opening 101 may be formed between the first side frame 120 and the second side frame 140. The first side frame 120 may be coupled to the front panel 110 to be disposed to face the window 92 (see FIG. 1). The second side frame 10 may be coupled to the front panel 110 to be disposed to face the window frame 91 (see FIG. 1). The extension frame 130 may be coupled to the front panel 110 to be disposed above the first side frame 120 and to face the window 92 (see FIG. 1).

The installation kit 100 may include an auxiliary frame 150. The auxiliary frame 150 may be coupled to and detached from the front panel 110. The auxiliary frame 150 may be disposed on a rear surface of the front panel 110. The auxiliary frame 150 may extend in the vertical direction. A vertical length of the auxiliary frame 150 may be smaller than the vertical length of the second side frame 140. The auxiliary frame 150 may be positioned above and spaced apart from the second side frame 140. The auxiliary frame 150 may be horizontally spaced apart from the extension frame 130. The auxiliary frame 150 may be disposed at an upper end of the front panel 110.

The installation kit 100 may include an inner gasket 160. The inner gasket 160 may be disposed to at least partially surround the opening 101. The inner gasket 160 may be disposed to at least partially surround the case 10 (see FIG. 1). The inner gasket 160 may be disposed between the case 10 and the installation kit 100.

The installation kit 100 may include a holder (or clip) 170. A plurality of holders 170 may be arranged to be horizontally spaced apart from each other. One or more of the holders 170 may be coupled to the extension frame 130. One or more of the holders 170 may be coupled to the auxiliary frame 150. The holders 170 may protrude upward from the extension frame 130. The holders 170 may protrude upward from the auxiliary frame 150. The holders 170 may protrude above the upper end of the front panel 110. The holders 170 may be fixed to the upper support 911 of the window frame 91 (see FIG. 1). The holders 170 may serve to fix the installation kit 100 to the window frame 91.

The installation kit 100 may include a case gasket 180. The case gasket 180 may be disposed to face the opening 101. The case gasket 180 may be coupled to the first side frame 120. The case gasket 180 may be disposed between the case 10 (see FIG. 1) of the air conditioner 1 and the first side frame 120.

The installation kit 100 may include a window gasket 190. The window gasket 190 may be disposed toward the outside of the installation kit 100. The window gasket 190 may be coupled to the first side frame 120. The window gasket 190 may be disposed between the window 92 (see FIG. 1) and the first side frame 120. As previously described, the first side frame 120 and the extension frame 130 may face the window 92 (see FIG. 1), and the window gasket 190 may seal a space between the window 92 and the first side frame 120 and a space between the window 92 and the extension frame 130.

The second side frame 140 may face a portion of the window frame 91 (see FIG. 1). For example, the second side frame 140 may face the side support 913 (see FIG. 1) of the window frame 91 or other portion of the window frame 91 opposite to the window 92. The second side frame 140 may contact the side support 913. In another example, a separate gasket (not shown) or other component may be disposed between the second side frame 140 and the side support 913.

The case gasket 180 may seal at least a portion of a space between the case 10 (see FIG. 1) and the first side frame 120. Similarly, the inner gasket 160 may seal at least a portion of a space between the case 10 (see FIG. 1) and the front panel 110.

Figure 5:
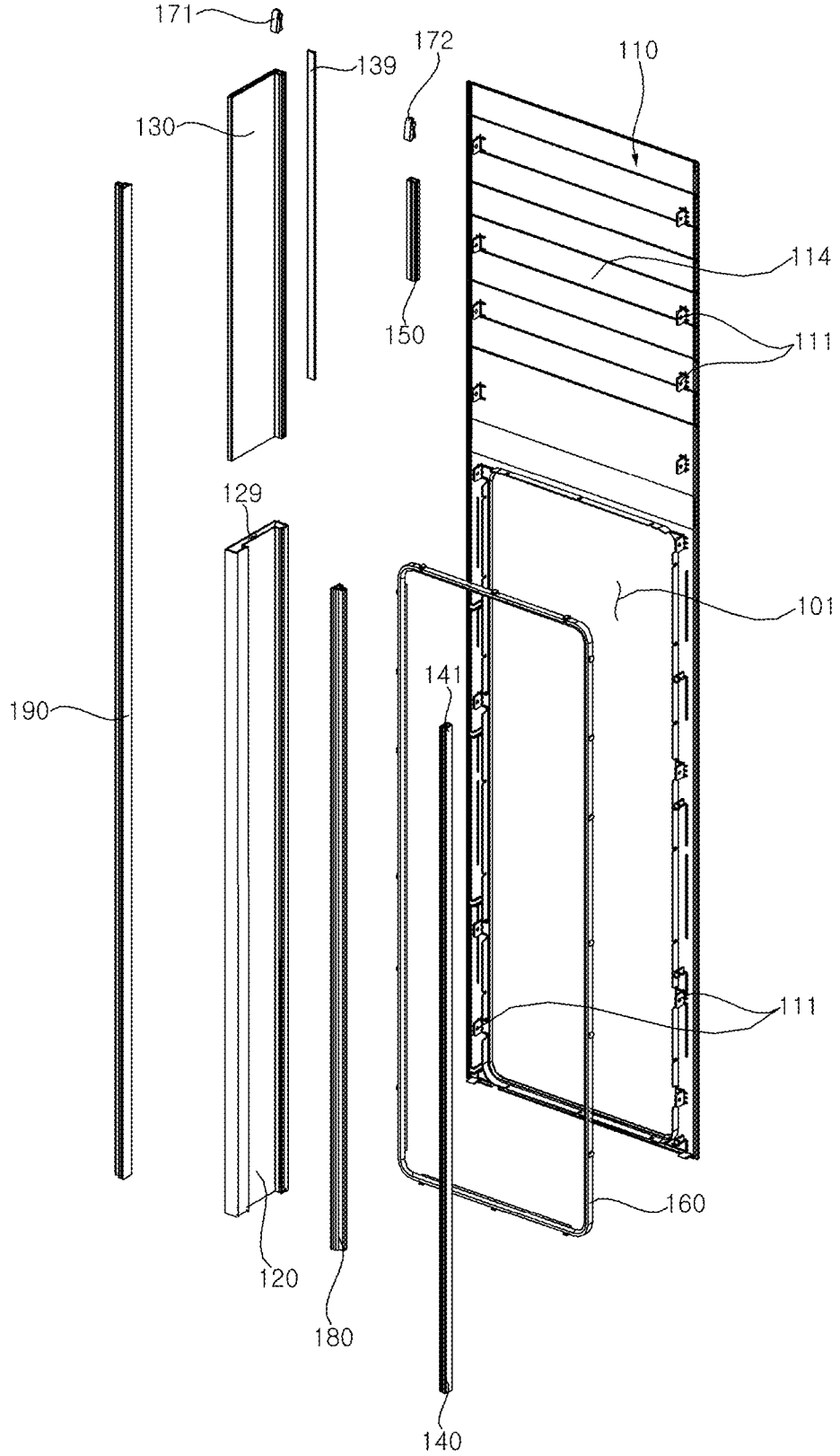
FIG. 5 is an exploded view of an installation kit according to an embodiment of the present disclosure.

Referring to FIG. 5, the installation kit 100 will be described below. FIG. 5 is an exploded view of the installation kit 100.

The front panel 110 may include a coupling rib 111. A plurality of coupling ribs 111 may be arranged to be vertically spaced apart from each other. The coupling ribs 111 may protrude rearward from a rear surface of the front panel 110. In another example, the coupling ribs 111 may be formed on both sides of the front panel 110.

The first side frame 120 may be coupled to and detached from the front panel 110. The first side frame 120 may be coupled to and detached from the front panel 110 on one side of the opening 101.

The second side frame 140 may be coupled to and detached from the front panel 110. The second side frame 140 may be coupled to and detached from the front panel 110 on one side of the opening 101. For example, the second side frame 140 may be coupled to and detached from the front panel 110 on a side of the opening 101 opposite to the first side frame 120.

The extension frame 130 may be coupled to and detached from the front panel 110. The extension frame 130 may be coupled to and detached from the front panel 110 on a same side and above the first side frame 120.

The first side frame 120 may include an extension frame insertion part (or extension frame insertion slot) 129. The extension frame 130 may be disposed in the extension frame insertion part 129 so as to be movable in the vertical direction. The extension frame 130 may move in the extension frame insertion part 129 to protrude upward from the first side frame 120.

The installation kit 100 may include a finishing member (or seal) 139. The finishing member 139 may be disposed between the extension frame 130 and the front panel 110. A gap may be formed between the extension frame 130 and the front panel 110. The finishing member 139 may be disposed in the gap between the extension frame 130 and the front panel 110.

The auxiliary frame 150 may be coupled to or detached from the front panel 110. The auxiliary frame 150 may be coupled to or detached from the front panel 110 at a position above the second side frame 140.

The holders 170 may include a first holder (or first clip) 171. The first holder 171 may be coupled to the extension frame 130. The holders 170 may include a second holder (or second clip) 172. The second holder 172 may be coupled to the auxiliary frame 150.

Figure 6:
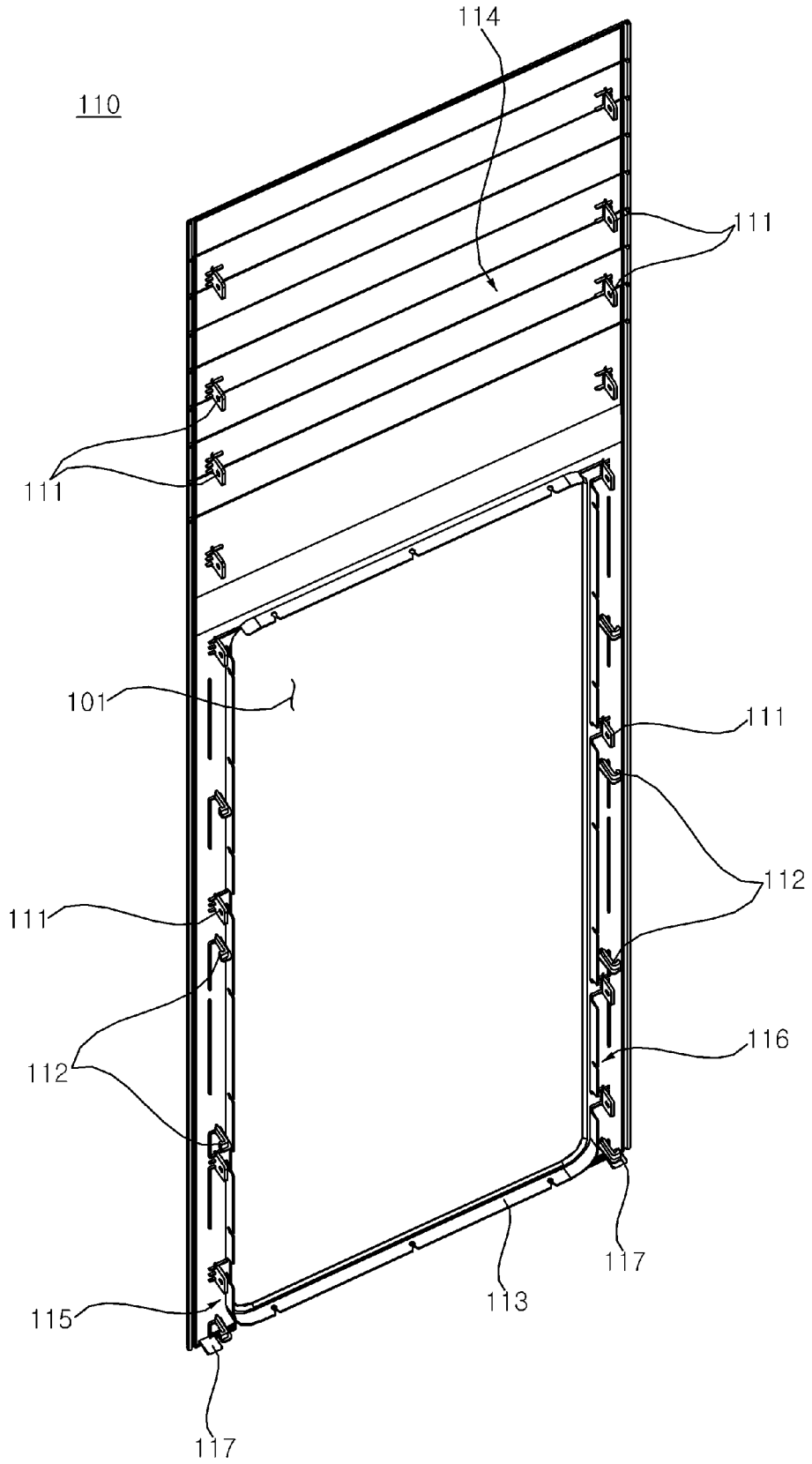
FIG. 6 is a perspective view of a front panel according to an embodiment of the present disclosure.
Figure 7:
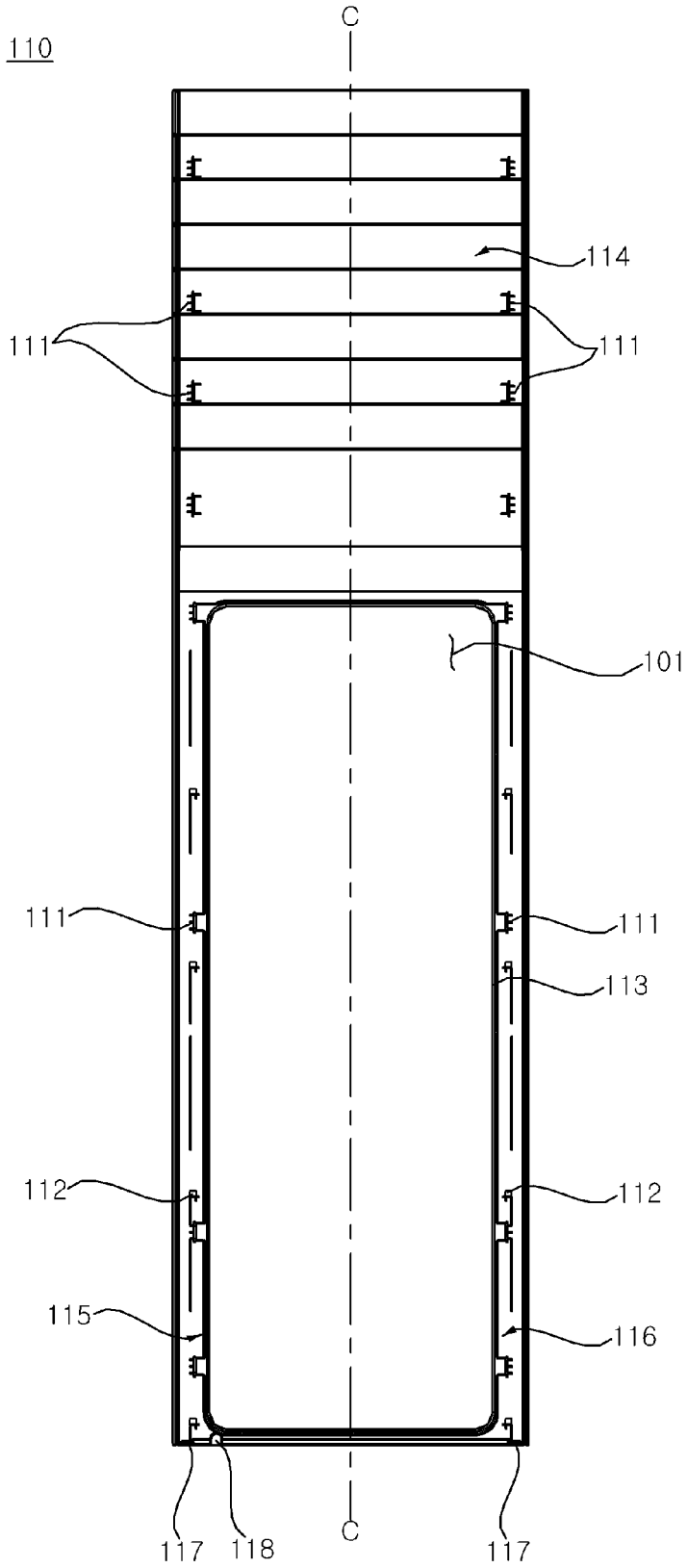
FIG. 7 is a rear view of a front panel according to an embodiment of the present disclosure.

Referring to FIGS. 6 and 7, the installation kit 100 will be described below. FIG. 6 is a perspective view of the front panel 110 as viewed obliquely, and FIG. 7 is a diagram illustrating the front panel 110 as viewed from the rear.

The front panel 110 may include a support protrusion 112. A plurality of support protrusions 112 may be arranged to be vertically spaced apart from each other. The support protrusions 112 may protrude rearward from the front panel 110. The support protrusions 112 may be formed between the plurality of coupling ribs 111. The support protrusions 112 may be formed on one side of the opening 101.

The front panel 110 may include a gasket coupling part 113. The gasket coupling part 113 may be formed to surround the opening 101. The gasket coupling part 113 may protrude rearward from the front panel 110. The inner gasket 160 (see FIG. 5) may be coupled to the gasket coupling part 113.

The front panel 110 may include a plate f. The plate 114 may be disposed above the opening 101. The plate 114 may be disposed above the air conditioner 1. A vertical height of the plate 114 may vary.

The front panel 110 may include a first coupling part (or first coupling region) 115. The first coupling part 115 may be formed on one side of the opening 101. The first coupling part 115 may extend in the vertical direction. The first side frame 120 (see FIG. 5) or the second side frame 140 (see FIG. 5) may be coupled to and detached from the first coupling part 115.

The front panel 110 may include a second coupling part (or second coupling region) 116. The second coupling part 116 may be formed on one side of the opening 101, such as to be positioned opposite to the first coupling part 115. The second coupling part 116 may extend in the vertical direction. The first side frame 120 (see FIG. 5) or the second side frame 140 (see FIG. 5) may be coupled to and detached from the second coupling part 116.

The front panel 110 may include a support rib 117. The support rib 117 may protrude rearward from a rear surface of the front panel 110. The support rib 117 may be formed at a lower portion of the front panel 110. At least one of the first side frame 120 (see FIG. 5) or the second side frame 140 (see FIG. 5) may be disposed above the support rib 117.

The plurality of coupling ribs 111 may be arranged to be vertically spaced apart from each other. Some of the plurality of coupling ribs 111 may be disposed on the plate 114, and these coupling ribs 111 may protrude rearward from the plate 114. Some of the plurality of coupling ribs 111 may be disposed below the plate 114. For example, some of the plurality of coupling ribs 111 may be formed on the first coupling part 115, and some of the plurality of coupling ribs 111 may be formed on the second coupling part 116.

A plurality of support protrusions 112 may be arranged to be vertically spaced apart from each other. Some of the plurality of support protrusions 112 may be formed on the first coupling part 115. Some of the plurality of support protrusions 112 may be formed on the second coupling part 116.

The gasket coupling part (or gasket coupling protrusion) 113 may be disposed between the first coupling part 115 and the second coupling part 116. The coupling ribs 111 and the support protrusions 112 may be spaced outside of the gasket coupling part 113.

The plate 114 may be disposed above the first coupling part 115 and the second coupling part 116. The plate 114 may be formed as one body with the first coupling part 115 and the second coupling part 116.

The opening 101 may be formed between the first coupling part 115 and the second coupling part 116. The first coupling part 115 and the second coupling part 116 may be symmetrical about the opening 101.

A plurality of support ribs 117 may be arranged to be horizontally spaced apart from each other. The first side frame 120 may be disposed on an upper side of any one of the plurality of support ribs 117. The second side frame 140 may be disposed on an upper side of another one of the plurality of support ribs 117. At least one of the plurality of support ribs 117 may be formed on the first coupling part 115. At least one of the plurality of support ribs 117 may be formed on the second coupling part 116.

The front panel 110 may be symmetrical about a center line C. The center line C may refer to an imaginary line horizontally passing through a center of the front panel 110.

The plurality of coupling ribs 111 may be provided symmetrically about the center line C in a left-right direction. For example, corresponding pairs thehe plurality of coupling ribs 111 may be formed, respectively, on the first coupling part 115 and the second coupling part 116. Similarly, corresponding pairs thehe plurality of coupling ribs 111 may be formed at respective sides of the plate 114.

The plurality of support protrusions 112 may be provided symmetrically about the center line C in the left-right direction. For example, corresponding pairs thehe plurality of support protrusions 112 may be formed on the first coupling part 115 and the second coupling part 116.

The opening 101 may be disposed between the pairs of the plurality of support protrusions 112. The corresponding pairs thehe plurality of coupling ribs 111 provided on the first coupling part 115 and the second coupling part 116 may face each other, with the opening 101 disposed therebetween. The pairs of the plurality of support ribs 112 may face each other with the opening 101 disposed therebetween.

The first coupling part 115 and the second coupling part 116 may be symmetrical about the center line C. The first coupling part 115 may be formed on one side of the opening 101, and the second coupling part 116 may be formed on another side of the opening 101. The opening 101 may be formed between the first coupling part 115 and the second coupling part 116. The first coupling part 115 and the second coupling part 116 may face each other with the opening 101 disposed therebetween.

Pairs thehe plurality of support ribs 117 may be provided symmetrically about the center line C. For example, one of the plurality of support ribs 117 may be formed on one side of the opening 101, and another corresponding one of the plurality of support ribs 117 may be formed on another side of the opening 101.

The front panel 110 may include a cord pass-through part (or cord pass-through opening) 118. The cord pass-through part 118 may be a space through which a wire or cord (not shown) connected to the air conditioner 1 passes. The cord pass-through part 118 may be formed at a lower portion of the front panel 110. The cord pass-through part 118 may be recessed forward. The cord pass-through part 118 may be formed under the opening 101 when the front panel is installed in space 93, 94.

Figure 8:
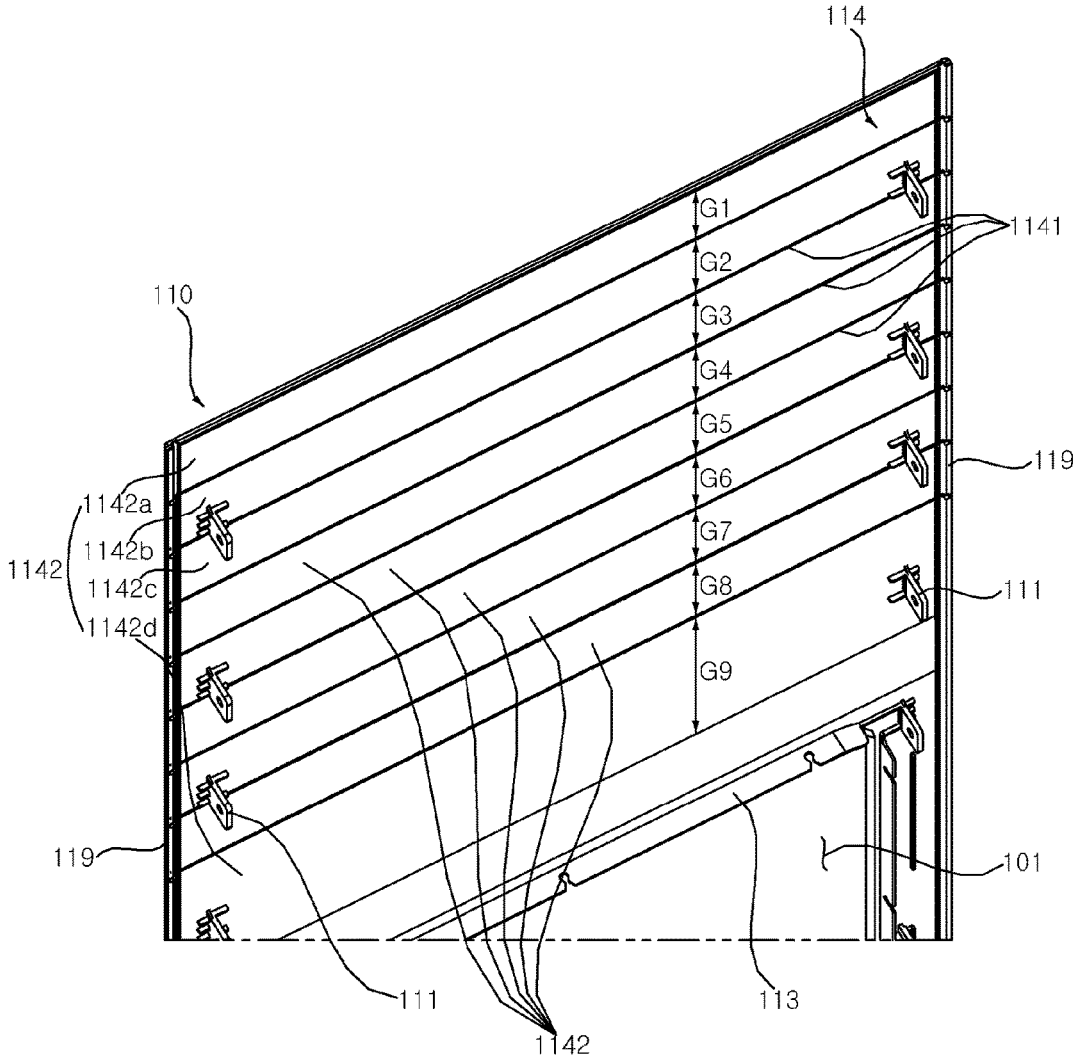
FIG. 8 is a diagram illustrating a portion of a front panel according to an embodiment of the present disclosure.
Figure 9:
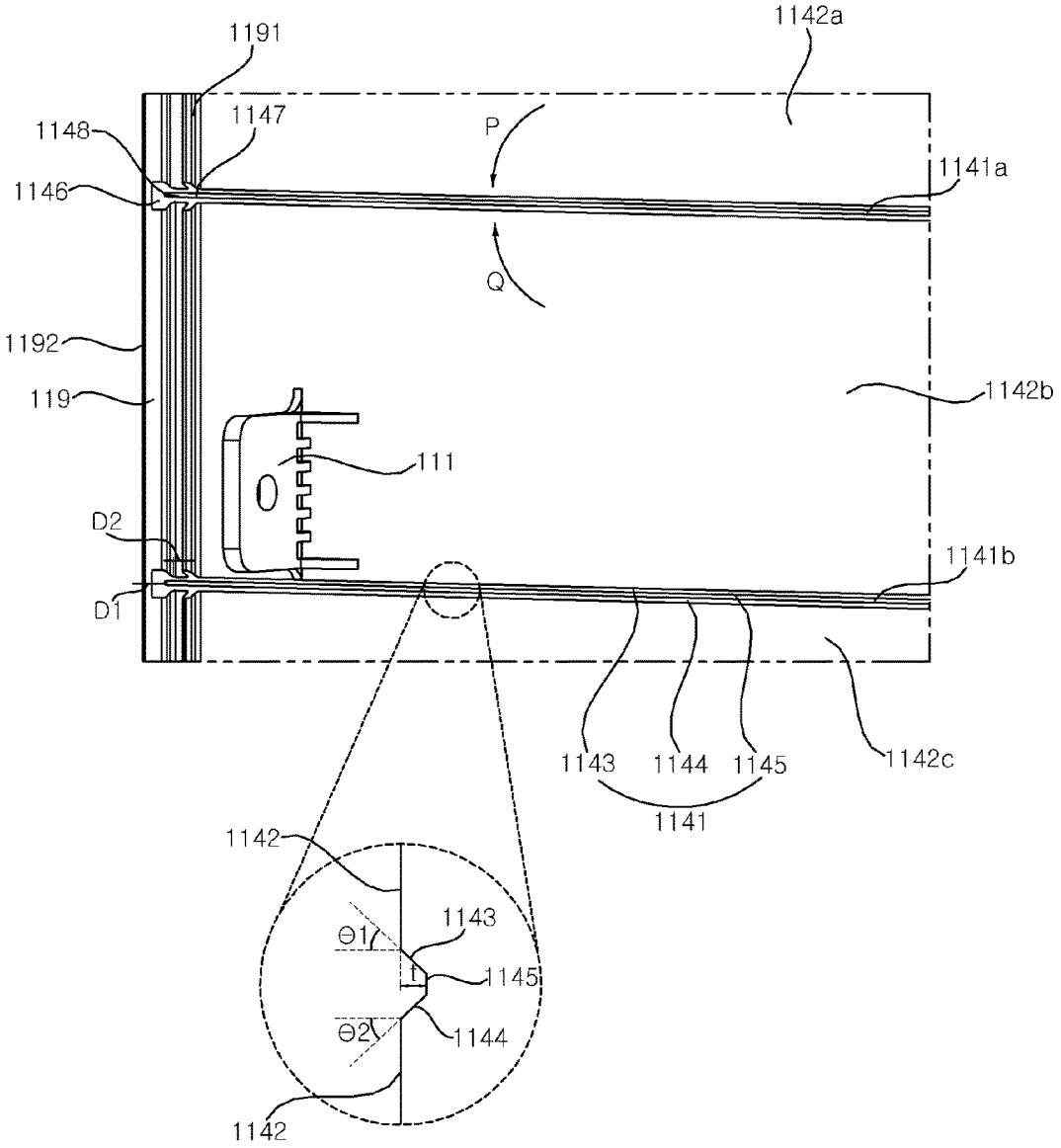
FIG. 9 is a diagram illustrating a portion of a front panel according to an embodiment of the present disclosure.

Referring to FIGS. 8 and 9, the installation kit 100 will be described below. FIG. 8 is an enlarged view of an upper portion of the front panel 110, and FIG. 9 is an enlarged view of the plate 114 of front panel 110. The front panel 110 may include an edge 119. The edge 119 may be formed at both side ends of the front panel 110. The edge 119 may include a lip that protrudes further rearward than the plate 114. The edge 119 may be formed outside of the opening 101. The edge 119 may be formed outside of the coupling ribs 111.

The plate 114 may have a cutting groove 1141. A plurality of cutting grooves 1141 may be formed to be vertically spaced apart from each other. The cutting grooves 1141 may be recessed forward from a rear surface of the plate 114. The cutting grooves 1141 may extend in the horizontal direction. The cutting grooves 1141 may be formed above the opening 101. The plurality of cutting grooves 1141 may be vertically spaced apart from each other. Gaps G1 to G9 may be formed between the plurality of cutting grooves 1141. The coupling ribs 111 may be disposed between the plurality of cutting grooves 1141. The coupling ribs 111 may protrude rearward from a cutting plate (or cutting plate region) 1142.

The plate 114 may include at least one of the cutting plate 1142. A plurality of cutting plates 1142 may be arranged in the vertical direction. The cutting plates 1142 may be a portion of the plate 114. Each of the cutting plates 1142 may extend in the horizontal direction. The cutting plates 1142 may be disposed above the opening 101. The plurality of cutting plates 1142 may be formed as one body.

The cutting grooves 1141 may be formed between the plurality of cutting plates 1142. The cutting plates 1142 may be formed between the plurality of cutting grooves 1141.

The plurality of cutting plates 1142 may include, for example, a first cutting plate 1142*a*, a second cutting plate 1142*b*, a third cutting plate 1142*c*, and a fourth cutting plate 1142*d*. The first to fourth cutting plates 1142*a*, 1142*b*, 1142*c*, and 1142*d* may be respectively referred to as the first, second, third, and fourth cutting plates in order from top to bottom. However, the number and names of the cutting plates 1142 are not limited thereto.

The plurality of cutting grooves 1141 may include a first cutting groove 1141*a* and a second cutting groove 1141*b*. The first cutting groove 1141*a* and may be disposed above the second cutting groove 1141*b*. The first cutting groove 1141*a* may be formed between the first cutting plate 1142*a* and the second cutting plate 1142*b*. The second cutting groove 1141*b* may be formed between the second cutting plate 1142*b* and the third cutting plate 1142*c*.

A user may adjust a vertical height of the front panel 110 by applying force to the plate 114. The user may adjust the vertical height of the front panel by bending the plate 114 to cut and remove one or more of the plurality of cutting plates 1142 from the front panel 110. For example, by bending the first cutting plate 1142*a* toward the rear in a first rotational direction P around the first cutting groove 1141*a* and/or by bending the second cutting plate 1142*b* in a second direction Q opposite to the first direction P, the front panel 110 may be cut at the first cutting groove 1141*a*. Due to the cut at the first cutting groove 1141*a*, the first cutting plate 1142*a* may be separated from the front panel 110. After the first cutting plate 1142*a* is separated from the front panel 110, the vertical height of the front panel 110 may be reduced by a length corresponding to a width of the first gap G1 associated with the first cutting plate 1142*a*. The user may cur the front panel 110 at different cutting grooves 1141 to bend and remove different ones of the cutting plates 1142. Based on the above principle, the user may adjust the vertical height of the front panel 110 by removing one or more of the cutting plates 1142 from the front panel 110.

The cutting groove 1141 may include a first inclined surface 1143. The first inclined surface 1143 may be inclined vertically, and the first inclined surface 1143 may have a first inclination angle 81 with respect to a front-rear direction. The cutting groove 1141 may include a second inclined surface 1144. The second inclined surface 1144 may be inclined vertically, and the second inclined surface 1144 may have a second inclination angle 82 with respect to the front-rear direction. The second inclined surface 1144 may be formed under the first inclined surface 1143.

The cutting groove 1141 may also include a cut surface 1145. The cut surface 1145 may connect the first inclined surface 1143 and the second inclined surface 1144. The cut surface 1145 may be disposed in front of a rear surface of the cutting plate 1142.

The first inclination angle 81 may be greater than 30 degrees. The first inclination angle 81 may be less than 60 degrees. The second inclination angle 82 may be greater than 30 degrees. The second inclination angle 82 may be less than 60 degrees. If the inclination angle 81, 82 of the cutting groove 1141 is less than a predetermined angle (e.g., 30 degrees), the plate 114 may decrease in thickness such that the rigidity of the plate 114 may also decrease. In addition, if the inclination angle 81, 82 of the cutting groove 1141 is greater than a predetermined angle (e.g., 60 degrees), it may be difficult to cut the cutting plate 1142, thereby requiring an excessive force to cut the cutting plate 1142. Accordingly, by optimizing the inclination angles 81, 82 of the cutting groove 1141, the rigidity of the plate 114 may be secured while facilitating cutting of the cutting plate 1142 by a user when bending the cutting plate 1142 at the cutting groove 1141.

A depth t of the cutting groove 1141 may refer to a distance from a rear surface of the plate 114 to the cut surface 1145. The depth t of the cutting groove 1141 may be greater than 1.5 mm. The depth t of the cutting groove 1141 may be less than 2 mm. If the depth t of the cutting groove 1141 is greater than a predetermined size (e.g., 2 mm), the plate 114 decreases in thickness, such that the rigidity of the plate 114 may decrease. In addition, if the depth t of the cutting groove 1141 is less than a predetermined size (e.g., less than 1.5 mm), it is difficult to cut the cutting plate 1142, thereby requiring an excessive force to cut the cutting plate 1142. Accordingly, by optimizing the depth t of the cutting groove 1141, the rigidity of the plate 114 may be secured while facilitating cutting of the cutting plate 1142 by a user.

The front panel 110 may include a reinforcement rib 1191. The reinforcement rib 1191 may protrude rearward from the front panel 110 and may extend in the vertical direction. The reinforcement rib 1191 may be positioned closer to the center line C of the front panel 110 than the edge 119. For example, the reinforcement rib 1191 may be spaced apart from the edge 119. The edge 119 may include a panel side surface 1192, and the panel side surface 1192 may form one side surface of the front panel 110, such that the reinforcement rib 1191 is spaced inward from panel side surface 1192.

The cutting groove 1141 may include an edge groove 1146. The edge groove 1146 may form an end portion of the cutting groove 1141. The edge groove 1146 may be formed by recessing a portion of the edge 119. The edge groove 1146 may include the first and second inclined surfaces 1143 and 1144 and the cut surface 1145.

The cutting groove 1141 may include a rib groove 1147. The rib groove 1147 may be spaced apart from the edge groove 1146. The rib groove 1147 may be formed by recessing a portion of the reinforcement rib 1191. The rib groove 1147 may include the first and second inclined surfaces 1143 and 1144 and the cut surface 1145.

The cutting groove 1141 may include a connection groove 1148. The connection groove 1148 may be formed between the edge groove 1146 and the rib groove 1147. The connection groove 1148 may connect the edge groove 1146 and the rib groove 1147.

The edge groove 1146 may be spaced apart from the panel side surface 1192. A gap D1 may be formed between the edge groove 1146 and the panel side surface 1192. Accordingly, when the front panel 110 is viewed from a lateral side, the cutting groove 1141 may not be seen. For example, the cutting groove 1141 may be covered by the edge 119 and thus may not be seen.

The gap D1 between the edge groove 1146 and the panel side surface 1192 may be greater than 1.2 mm. The gap D1 between the edge groove 1146 and the panel side surface 1192 may be less than 3 mm. If the gap D1 between the edge groove 1146 and the panel side surface 1192 is too large (e.g., more than 3 mm), it may be difficult to cut the cutting plate 1142, such that an excessive force from a user may be required to cut the cutting plate 1142. In addition, if the gap D1 between the edge groove 1146 and the panel side surface 1192 is too small (e.g., less than 1.2 mm), the rigidity of the plate 114 decreases, thereby causing a problem in that the cutting plate 1142 may be cut even when little or no force is inadvertently applied thereto. Further, if the gap D1 is not formed between the edge groove 1146 and the panel side surface 1192 such that the cutting groove 1141 extends to the edge of panel side surface 1192, the cutting groove 1141 may be viewed from the outside of the front panel 110, thereby degrading the appearance of the installation kit 100. Accordingly, by optimizing the gap D1 between the edge groove 1146 and the panel side surface 1192 in the installation kit 100 of the present disclosure, sufficient rigidity may be secured and the plate 114 may be easily cut while maintaining a desirable smooth panel side surface 1192.

The edge groove 1146 and the rib groove 1147 may be spaced apart from each other. A gap D2 may be formed between the edge groove 1146 and the rib groove 1147. The connection groove 1148 may have a length corresponding to the gap D2.

Figure 10:
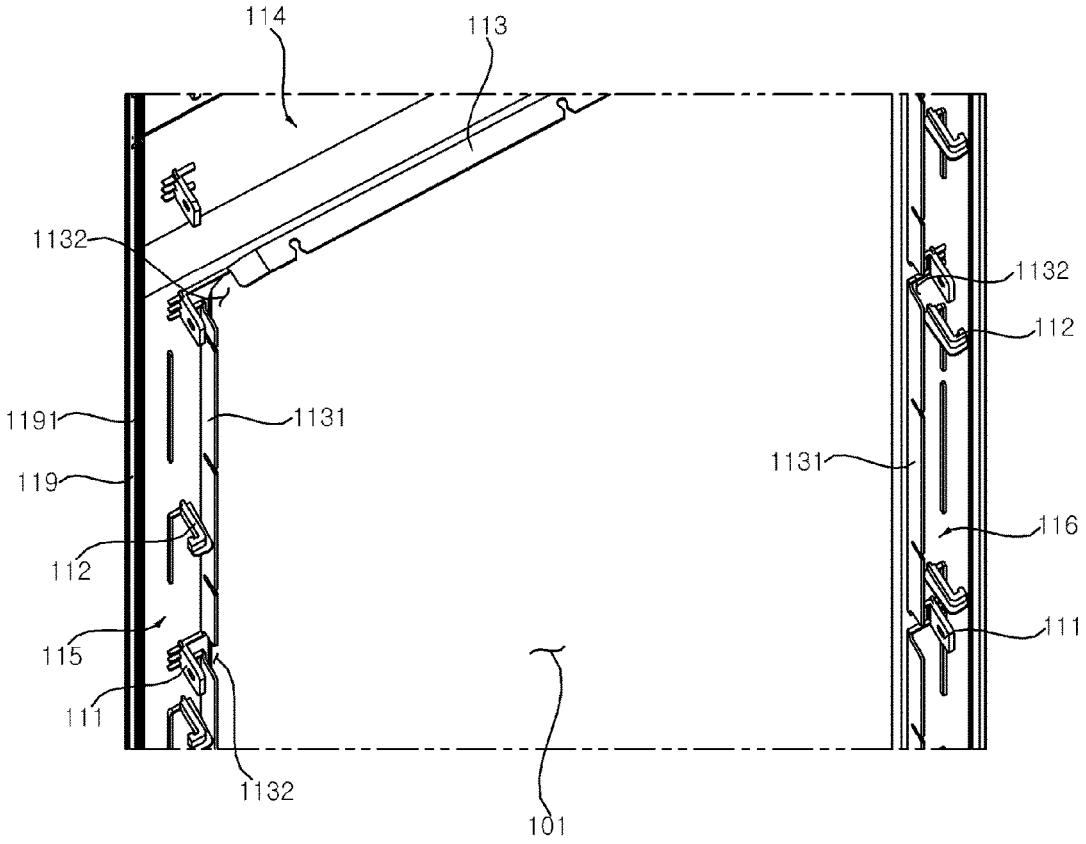
FIG. 10 is a diagram illustrating a portion of a front panel according to an embodiment of the present disclosure.

Referring to FIG. 10, the installation kit 100 will be described below. FIG. 10 is an enlarged view of a portion of the front panel 110. The gasket coupling part 113 may be formed under the plate 114. The opening 101 may be formed inside of the gasket coupling part 113.

The gasket coupling part may include a gasket coupling rib 1131. The gasket coupling rib 1131 may extend around at least a portion of the periphery of the opening 101. The gasket coupling rib 1131 may protrude rearward of the front panel 110. The inner gasket 150 (see FIG. 5) may be coupled to the gasket coupling rib 1131.

The gasket coupling part 113 may include at least one rib opening part (or rib opening) 1132. The rib opening part 1132 may be formed by cutting the gasket coupling rib 1131. The rib opening part 1132 may be cut around a portion of the opening 101. A plurality of rib opening parts 1132 may be spaced apart from each other in an extending direction of the gasket coupling rib 1131. Certain ones of the rib opening part 1132 may be positioned in the first coupling part 115. In another example, other ones of the rib opening part 1132 may be positioned in the second coupling part 116. The rib opening parts 1132 may face the coupling ribs 111. The rib coupling parts 1132 may be formed at positions corresponding to the coupling ribs 111. A fastening member (or fastener) 1112 (see FIG. 14) may pass through the rib opening part 1132 to be fastened to the coupling rib 111.

The support protrusion 112 may face the gasket coupling rib 1131. The support protrusion 112 may be disposed between a pair of the plurality of rib coupling parts 1132. The coupling rib 111 may be disposed between the edge 119 and the gasket coupling rib 1131, and the support protrusion 112 may be disposed between the edge 119 and the gasket coupling rib 1131. In another example, the coupling rib 111 may be disposed between the reinforcement rib 1191 and the gasket coupling rib 1131, and the support protrusion 112 may be disposed between the reinforcement rib 1191 and the gasket coupling rib 1131.

Figure 11:
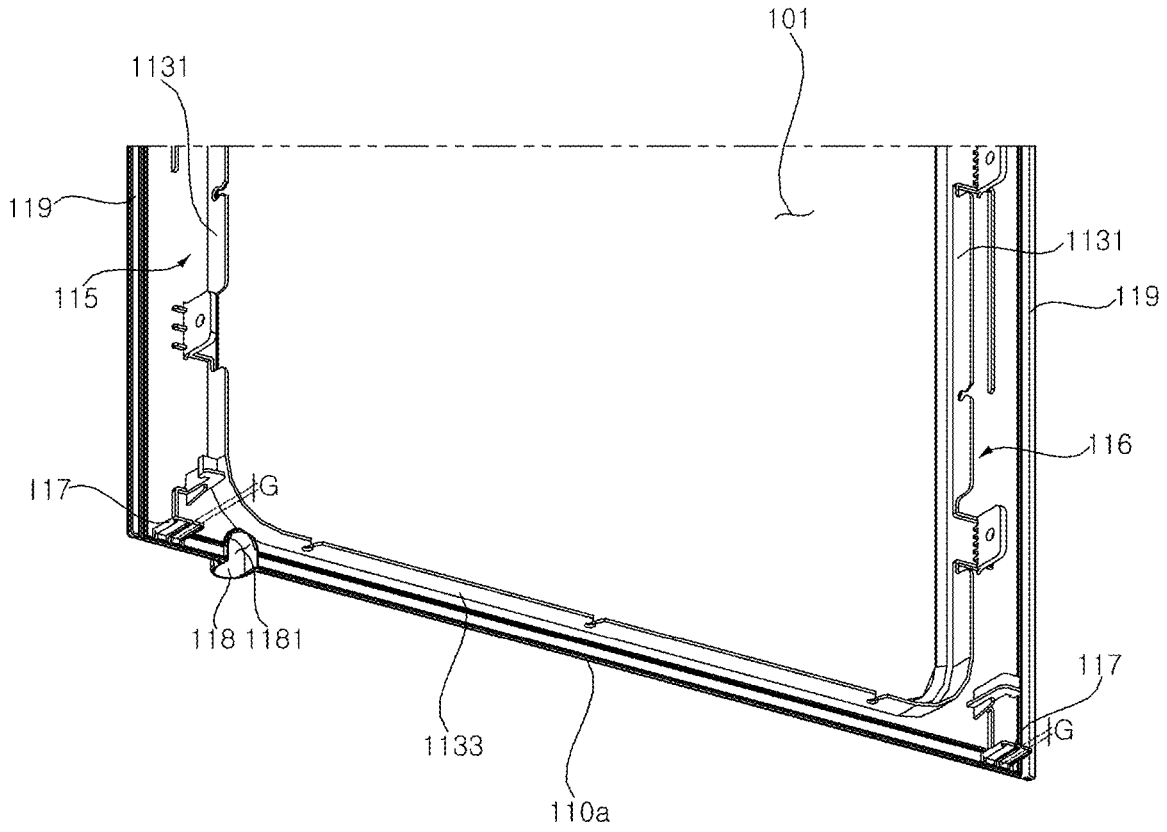
FIG. 11 is a diagram illustrating a portion of a front panel according to an embodiment of the present disclosure.

Referring to FIG. 11, the installation kit 100 will be described below. FIG. 11 is an enlarged view of a lower portion of the front panel 110. The gasket coupling part 113 may include a coupling part lower end 1133 provided at the lower portion of the front panel 110. The coupling part lower end 1133 may be coupled to a lower portion of the inner gasket 160 (see FIG. 5). The coupling part lower end 1133 may extend in the horizontal direction.

The front panel 110 may include a panel lower end 110*a*. The panel lower end 110*a* may form a lower surface of the front panel 110. The panel lower end 110*a* may be spaced below the opening 101. The panel lower end 110*a* may be disposed under the coupling part lower end 1133. At least one support rib 117 may be disposed above the panel lower end 110*a*. A gap G may be formed between the support rib 117 and a bottom of the panel lower end 110*a*. The support rib 117 may be disposed below the coupling part lower end 1133. The support rib 117 may be positioned at a height between the coupling part lower end 1133 and the panel lower end 110*a*.

The support rib 117 may be seated on top of the lower support 912 (see FIG. 1) of window frame 91. For example, the support rib 117 may allow the installation kit 100 to be seated on the window frame 91 (see FIG. 1). The above structure allows the support rib 117 to be stably seated on the window frame 91 (see FIG. 1). In addition, by forming the gap G between the support rib 117 and the bottom of the panel lower end 110*a*, the installation kit 100 may be firmly fixed to the window frame 91 (see FIG. 1). For example, a lower portion of the front panel 110, at which the support rib 117 is disposed, may be force-fitted into or otherwise coupled to the lower support 912 (see FIG. 1) of the window frame 91 (see FIG. 1).

The cord pass-through part 118 may be formed in the panel lower end 110*a*. The cord pass-through part 118 may protrude forward. The cord pass-through part 118 may be formed under the coupling part lower end 1133. The cord pass-through part 118 may be formed under the opening 101 (e.g., between. The cord pass-through part 118 may protrude further forward than the front surface of the front panel 110. The cord pass-through part 118 may have a space 1181 formed therein, through which a cord passes. A wire (or cord) connected to the air conditioner 1 may pass through the cord pass-through part 118 to extend into an indoor space.

Figure 12:
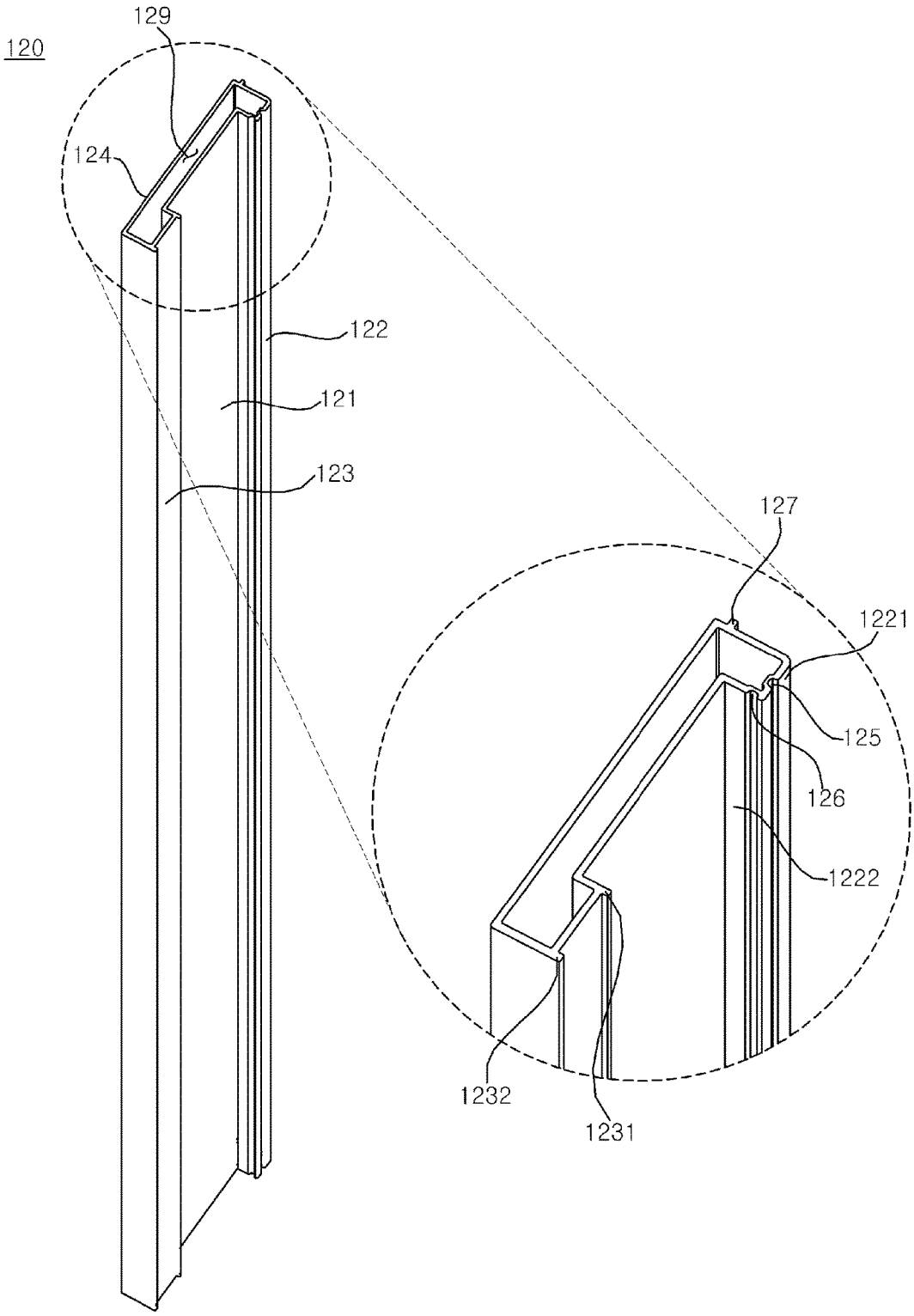
FIG. 12 is a perspective view of a first side frame according to an embodiment of the present disclosure.

Referring to FIG. 12, the installation kit 100 will be described below. FIG. 12 is a diagram illustrating the first side frame 120. The first side frame 120 may include a first body 121. The first body 121 may extend in the vertical direction. The extension frame insertion part (or extension frame insertion slot) 129 may be formed inside the first body 121. A portion of the extension frame 130 (see FIG. 5) may be received inside the first body 121 so as to be movable in the vertical direction.

The first side frame 120 may include a first frame coupling part (or first frame coupling protrusion) 122. The first frame coupling part 122 may protrude from the first body 121.

The first side frame 120 may include a gasket fixing part (or gasket fixing protrusion) 123. The gasket fixing part 123 may protrude from the first body 121. The gasket fixing part 123 may be spaced apart from the first frame coupling part 122. The gasket fixing part 123 may be disposed behind the first frame coupling part 122.

The first side frame 120 may include a first outer surface 124. The first outer surface 124 may be a surface facing the window 92 (see FIG. 1).

The first side frame 120 may include a first fastening groove 125. The first fastening groove 125 may be recessed into the first frame coupling part 122. For example, the first fastening groove 125 may be recessed into a first coupling surface 1221. The first fastening groove 125 may be referred to as a "fastening groove." The term "fastening groove" may collectively refer to the first fastening groove 125 and a second fastening groove 144 included in second side frame 140 (see FIG. 17).

The first side frame 120 may include a first support groove 126. The first support groove 126 may be recessed into the first frame coupling part 122. For example, the first support groove 126 may be recessed into a first support surface 1222. The first support groove 126 may be referred to as a "support groove." The term "support groove" may collectively include the first support groove 126 and a second support groove 145 included in second side frame 140 (see FIG. 17).

The first side frame 120 may include a guide protrusion 127. The guide protrusion 127 may protrude forward from the first body 120. For example, the guide protrusion 127 may protrude from a surface of the first body 120 facing a rear surface of front panel 110.

The first frame coupling part 122 may include a first coupling surface 1221 that extends rearward from front panel 110. The first coupling surface 1221 may face the coupling ribs 111 (see FIG. 14). The first fastening groove 125 may be formed in the first coupling surface 1221.

The first frame coupling part 122 may include a first support surface 1222 that extends from the first coupling surface 1221. The first support surface 1222 may face the support protrusions 112 (see FIG. 14). The first support groove 126 may be formed in the first support surface 1222. The first support surface 1222 may extend in a direction intersecting the first coupling surface 1221. For example, the first support surface 1222 may extend toward window 92.

The gasket fixing part 123 may include a first gasket support rib 1231 and a second gasket support rib 1232 that protrude from gasket fixing part 123 toward air conditioner 1. The case gasket 180 (see FIG. 5) may be disposed between the first gasket support rib 1231 and the second gasket support rib 1232.

Figure 13:
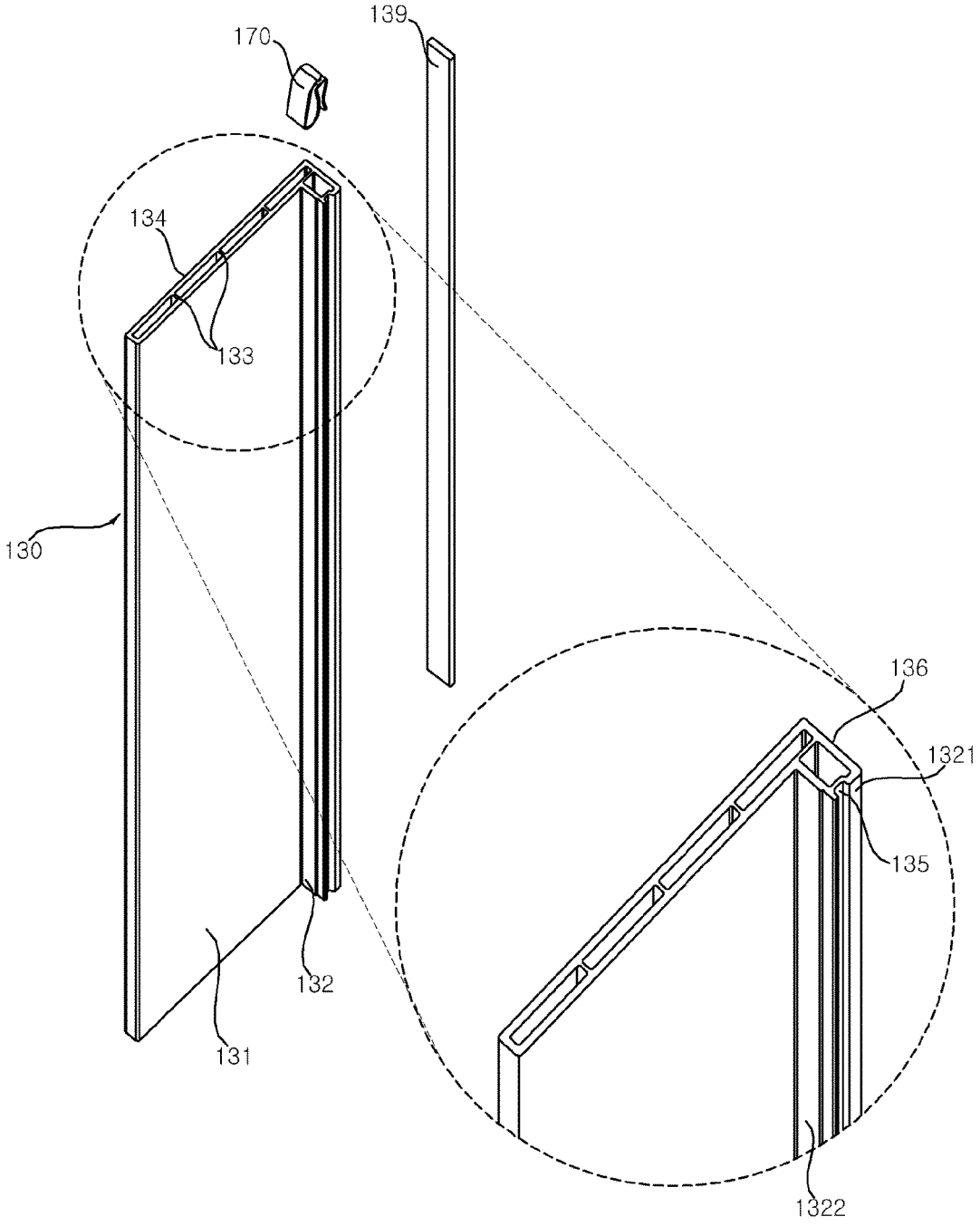
FIG. 13 is a diagram illustrating a portion of an installation kit according to an embodiment of the present disclosure.

Referring to FIG. 13, the installation kit 100 will be described below. FIG. 13 is an exploded view of the extension frame 130, the finishing member 139, and the holder 170. The extension frame 130 may include an extension body 131. The extension body 131 may extend in the vertical direction. The extension body 131 may be disposed in the extension frame insertion part 129 (see FIG. 12) of first side frame 120 so as to be movable in the vertical direction.

The extension frame 130 may include an extension frame coupling part (or extension frame coupling protrusion) 132. The extension frame coupling part 132 may protrude from the extension body 131. The extension frame coupling part 132 may be received in the first frame coupling part 122 (see FIG. 12) of first side frame 120 so as to be movable in the vertical direction.

The extension frame 130 may include at least one extension frame rib 133. The extension frame rib 133 may be disposed inside the extension body 131. For example, the extension frame rib 133 may maintain a space separating extension frame outer surface 134 and an opposing inner surface of the extension body 131

The extension frame 130 may include an extension frame outer surface 134. The extension frame outer surface 134 may be a surface facing the window 92 (see FIG. 1).

The finishing member (or seal) 139 may be detached from one side of the extension frame coupling part 132. The holder 170 may be detached from an upper side of the extension body 131.

The extension frame 130 may include an extension frame fastening groove 135. The extension frame fastening groove 135 may be recessed into a wall of the extension frame coupling part 132.

The extension frame 130 may include a finishing member coupling part (or finishing member coupling surface) 136. For example, the finishing member coupling part 136 may be provided on a surface of the extension frame coupling part 132 facing the front panel 110. The finishing member coupling part 136 may be spaced apart from the front panel 110 (see FIG. 14). The finishing member 139 may be coupled to and detached from the finishing member coupling part 136.

The extension frame coupling part 132 may include an extension frame coupling surface 1321. The extension frame coupling surface 1321 may face the coupling ribs 111 (see FIG. 14). The extension frame fastening groove 135 may be formed in the extension frame coupling surface 1321.

The extension frame coupling part 132 may include an extension frame support surface 1322. The extension frame support surface 1322 may face the support protrusions 112 (see FIG. 14). The extension frame support surface 1322 may extend in a direction intersecting the extension frame coupling surface 1321.

Figure 14:
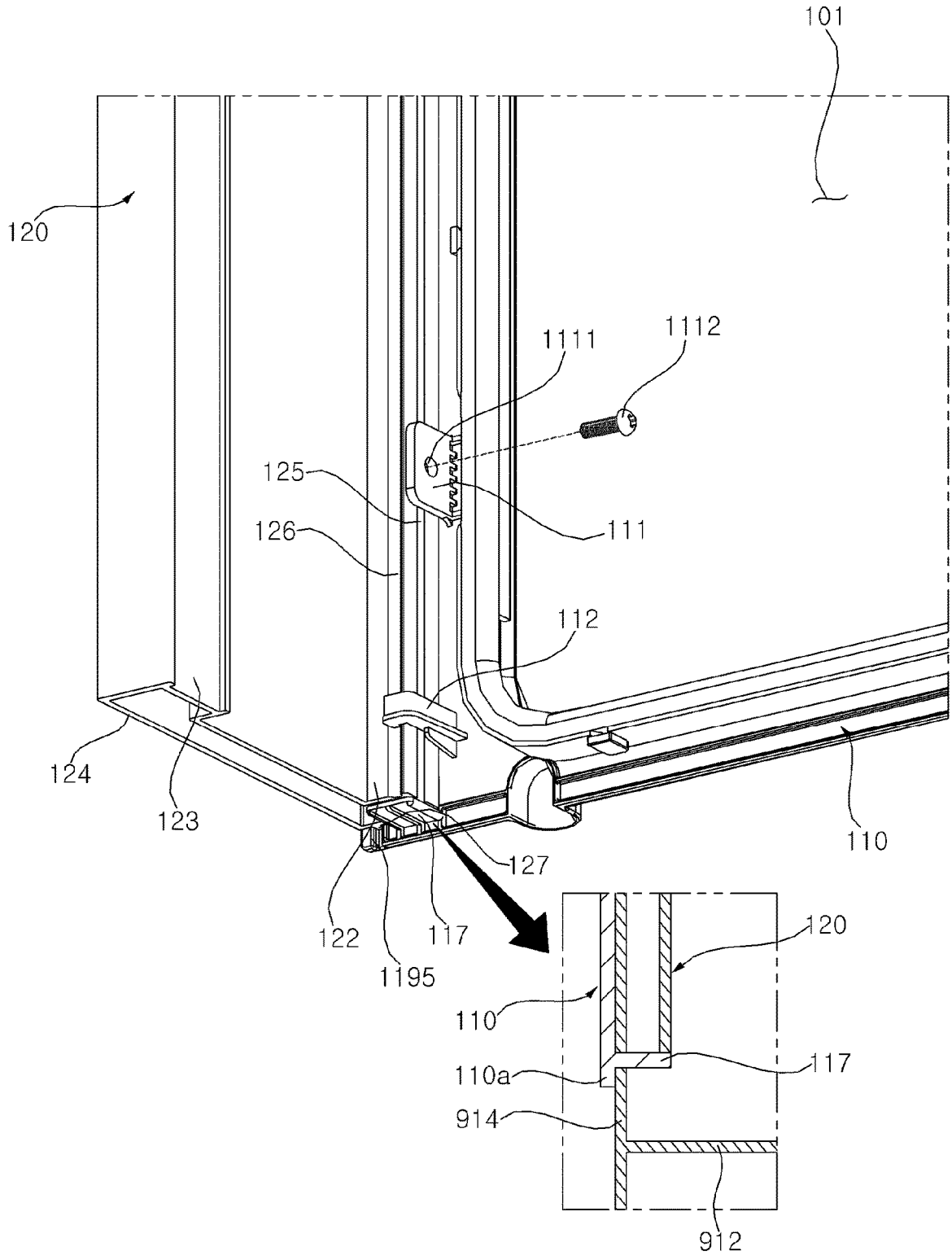
FIG. 14 is a diagram illustrating a portion of an installation kit according to an embodiment of the present disclosure.
Figure 15:
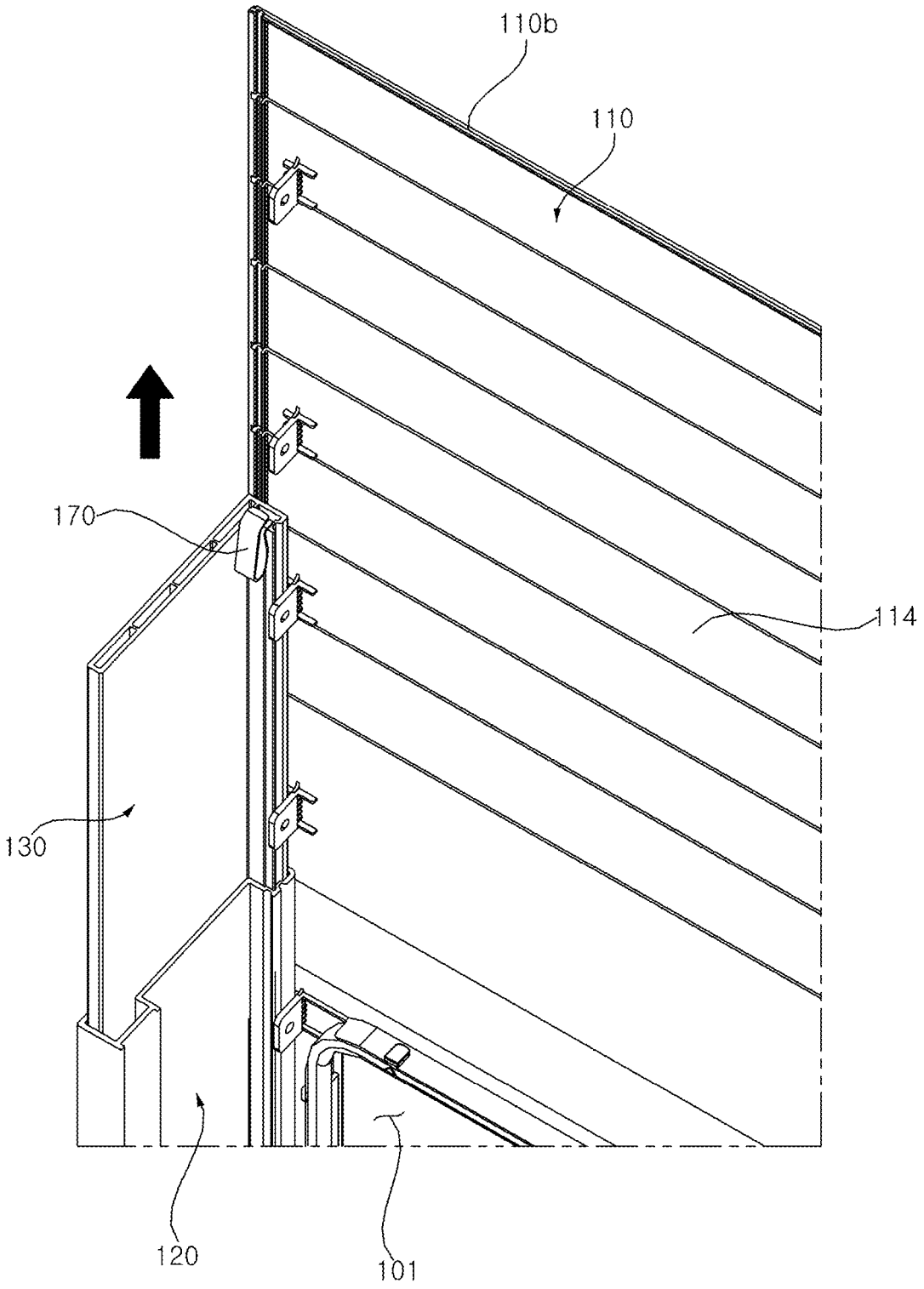
FIG. 15 is a diagram illustrating a portion of an installation kit according to an embodiment of the present disclosure.
Figure 16:
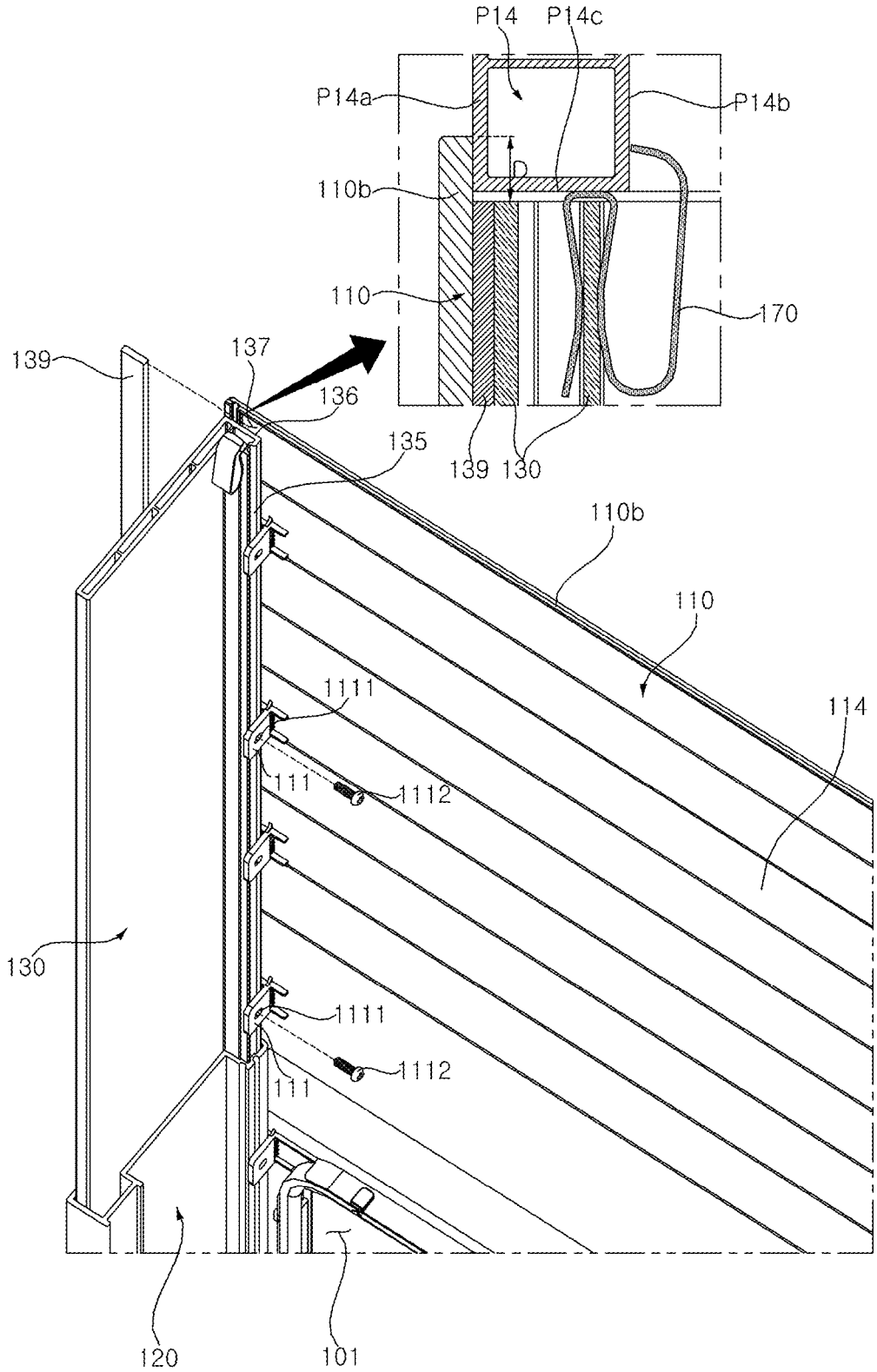
FIG. 16 is a diagram illustrating a portion of an installation kit according to an embodiment of the present disclosure.

Referring to FIGS. 14 to 16, the installation kit 100 will be described below. FIG. 14 is a diagram illustrating a lower structure of the installation kit 100 when the first side frame 120 is coupled to the front panel 110. FIG. 15 is a diagram illustrating an upper structure of the installation kit 100 when the first side frame 120 and the extension frame 130 are coupled to the front panel 110. FIG. 16 is a diagram illustrating the installation kit 100 after the extension frame 130 is raised.

Referring to FIG. 14, the first side frame 120 may be coupled to the front panel 110. The front panel 110 may be coupled to the window frame 91. For example, a lower portion of the front panel 110 may be inserted into the window frame 91.

The support rib 117 may be seated on the window frame 91. The support rib 117 may be seated on top of the window frame front end 914. For example, the support rib 117 may be disposed between the first side frame 120 and the window frame front end 914. The panel lower end 110*a* may be disposed below the support rib 117. A gap G (see FIG. 11) may be formed between the bottom of the panel lower end 110*a* and the support rib 117. The panel lower end 110*a* may be formed at the front of the window frame front end 914. The panel lower end 110*a* protrudes below the support rib 117, to be disposed at the front of the window frame front end 914.

The above structure of the support rib 117 and the panel lower end 110*a* allows the lower portion of the installation kit 100 to be firmed fixed to the window frame 91. A user may fix the installation kit 100 to the window frame 91 by seating the support rib 117 at the window frame front end 914 and by pressing the panel lower end 110*a* against the front of the window frame front end 914. The first side frame 120 may be seated on the support rib 117. The first side frame 120 may extend upward from an upper side of the support rib 117.

The front panel 110 may include a guide groove 1195. The guide groove 1195 may extend in the vertical direction. The guide groove 1195 may be formed between the coupling rib 111 and the edge 119. The guide protrusion 127 may be inserted into the guide groove 1195. A structure in which the guide protrusion 127 is inserted into the guide groove 1195 may guide the first side frame 120 to be disposed on the front panel 110.

The first frame coupling part 122 may be coupled to the front panel 110. The first fastening groove 125 may face the coupling rib 111. The first support groove 126 may face the support protrusions 112. The coupling rib 111 may include a fastening hole 1111. The installation kit 100 may include the fastening member 1112. The fastening member 1112 may pass through the fastening hole 1111 and the first fastening groove 125. The fastening member 1112 may allow the coupling rib 111 and the first side frame 120 to be coupled to each other.

The first fastening groove 125 may be recessed in a direction away from the coupling rib 111. The first fastening groove 125 may be recessed in a direction in which the fastening member 1112 is inserted. Accordingly, the fastening member 1112 may be easily inserted into the first frame coupling part 122.

The support protrusion 112 may be engaged with the first support groove 126. The support protrusion 112 may support the first side frame 120. The gasket fixing part 123 may be spaced behind the front panel 110. The first outer surface 124 may be disposed toward the outside of the front panel 110.

Referring to FIG. 15, the extension frame 130 be initially at least partially inserted into the first side frame 120 and may move upward from the first side frame 120. The front panel 110 may include a panel upper end 110*b*. The panel upper end 110*b* may form an upper surface of the front panel 110. The panel upper end 110*b* may be an upper end of the plate 114 (see FIG. 8).

The first side frame 120 may be spaced below the panel upper end 110*b*. The extension frame 130 may be slidably received in the first side frame 120 and may move toward the panel upper end 110*b* from the first side frame 120. The holder 170 may move toward the panel upper end 110*b* along with the extension frame 130.

Referring to FIG. 16, the extension frame 130 may be disposed at the panel upper end 110*b*. The front panel 110 may be coupled to the window frame 91. The upper portion of the front panel 110 may be inserted into the window frame 91. The panel upper end 110*b* may be disposed at the front of the window frame 91. For example, the panel upper end 110*b* may be disposed at the front of the window frame front end 914. Thus, the panel upper end 110*b* may cover the front of the window frame front end 914.

The window frame front end 914 may include a first surface 914*a*, a second surface 914*b*, and a third surface 914*b*. The first surface 914*a* may be a surface facing an indoor space. The second surface 914*b* may be spaced behind the first surface 914*a*. The second surface 914*b* may be a surface facing a space between the frame 91 and the window 92 in which the air conditioner 1 is disposed. The third surface 914*c* may connect the first surface 914*a* and the second surface 914*b*.

The panel upper end 110*b* may be disposed at the front of (e.g., further inside of) the first surface 914*a*. The panel upper end 110*b* may contact the first surface 914*a*. The panel upper end 100*b* may cover the front of the first surface 914*a*. The panel upper end 110*b* may be disposed above the third surface 914*c*. The panel upper end 110*b* may protrude above the third surface 914*c*, to be disposed at the front of the window frame front end 914.

The extension frame 130 may be disposed below the panel upper end 110*b*. A vertical gap D may be formed between a top of the panel upper end 110*b* and the extension frame 130. The finishing member 139 may be disposed below the panel upper end 110*b*. A vertical gap D may be formed between the top of the panel upper end 110*b* and the finishing member 139.

The extension frame 130 may be disposed below the third surface 914*c*. The extension frame 130 may be spaced below the third surface 914*c*. The finishing member 139 may be disposed below the third surface 914*c*. In certain examples, the finishing member 139 may be spaced below the third surface 914*c*.

The holder 170 may be hung on the window frame 91. The holder 170 may fix the upper portion of the installation kit 100 to the window frame 91. A portion of the holder 170 may be disposed between the window frame front end 914 and the extension frame 130. An end portion of the holder 170 may be hung on the second surface 914*b* of the window frame front end 914. The holder 170 may restrict an upward movement of the installation kit 100.

The above structure allows the upper portion of the installation kit 100 to be firmly fixed to the window frame 91. By hanging the holder 170 on the window frame 91 and hanging the panel upper end 110*b* on the window frame 91, a user may fix the installation kit 100 to the window frame 91.

The extension frame fastening groove 135 may face the coupling rib 111. The fastening member 112 passes through the fastening hole 1111 and the extension frame fastening groove 135 so that the extension frame 130 and the coupling rib 111 may be coupled to each other.

The finishing member coupling part 136 may be spaced apart from the front panel 110. A gap 137 may be formed between the finishing member coupling part 136 and the front panel 110. The finishing member 139 is inserted into the gap 137, to be coupled to the extension frame 130 and the front panel 110. The finishing member 139 may be attached to the extension frame 130 by adhesive tape. The finishing member 139 may be attached to the front panel 110 by adhesive tape.

Figure 17:
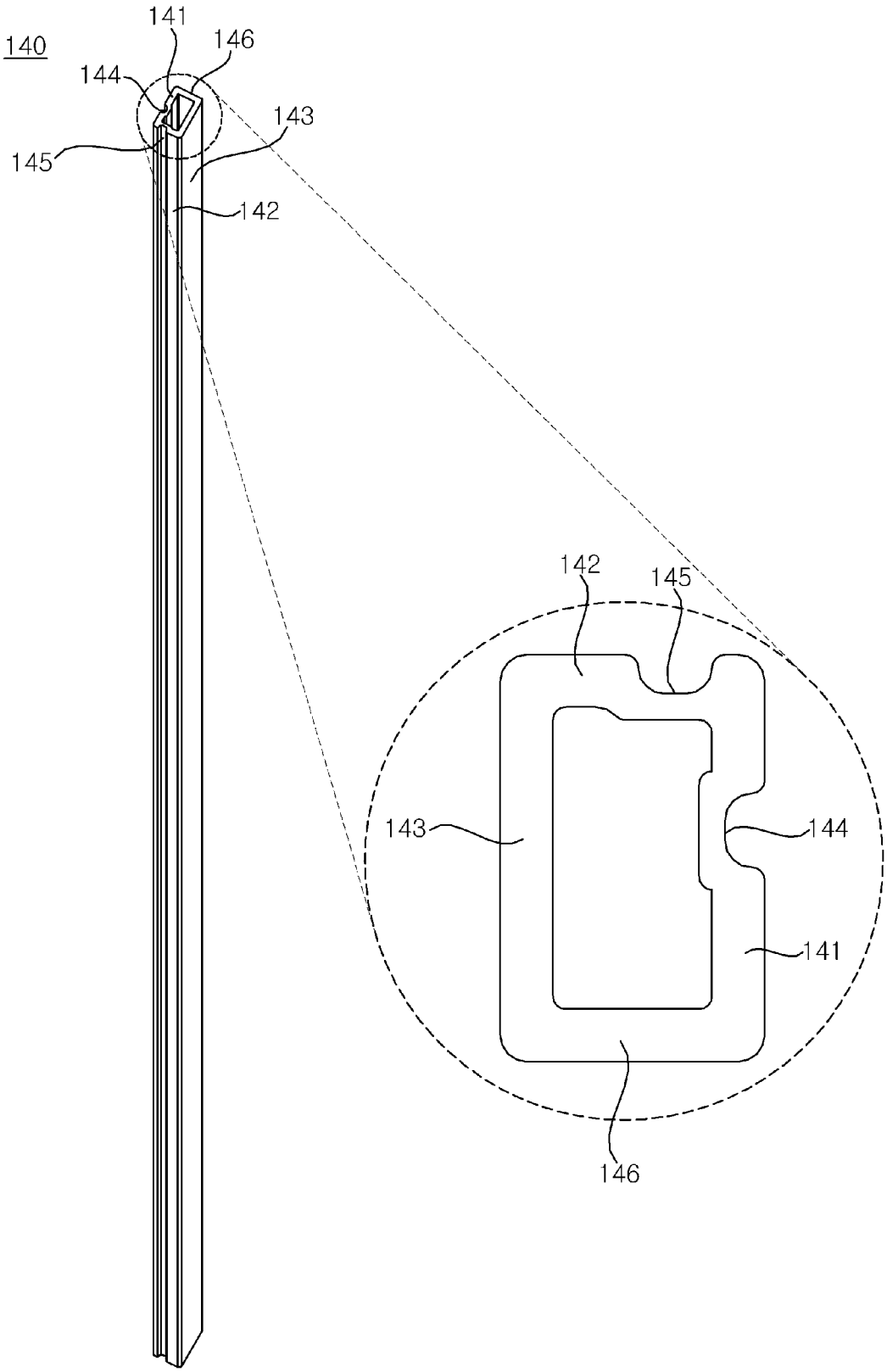
FIG. 17 is a perspective view of a second side frame according to an embodiment of the present disclosure.

Referring to FIG. 17, the installation kit 100 will be described below. More specifically, FIG. 17 is a diagram illustrating the second side frame 140.

The second side frame 140 may include a second frame coupling part (or second frame coupling wall) 141, a second frame support (or second frame support wall) 142, a second outer surface (or second outer wall) 143, and panel facing surface (or panel facing wall) 146. The second frame coupling part 141 may extend in the vertical direction. The second frame support 142 may extend in the vertical direction. For example, the second frame support 142 may extend in a direction intersecting the second frame coupling part 141. The second outer surface 143 may face the window frame 91 (see FIG. 1). In certain examples, the second outer surface 143 may be spaced apart from the second frame coupling part 141. The panel facing surface 146 may face the front panel 110 (see FIG. 19). In certain examples, the panel facing surface 146 may be spaced apart from the second frame support 142.

The second side frame 140 may include a second fastening groove 144 and a second support groove 145. The second fastening groove 144 may be recessed into the second frame coupling part 141. The second support groove 145 may be recessed into the second frame support 142.

Figure 18:
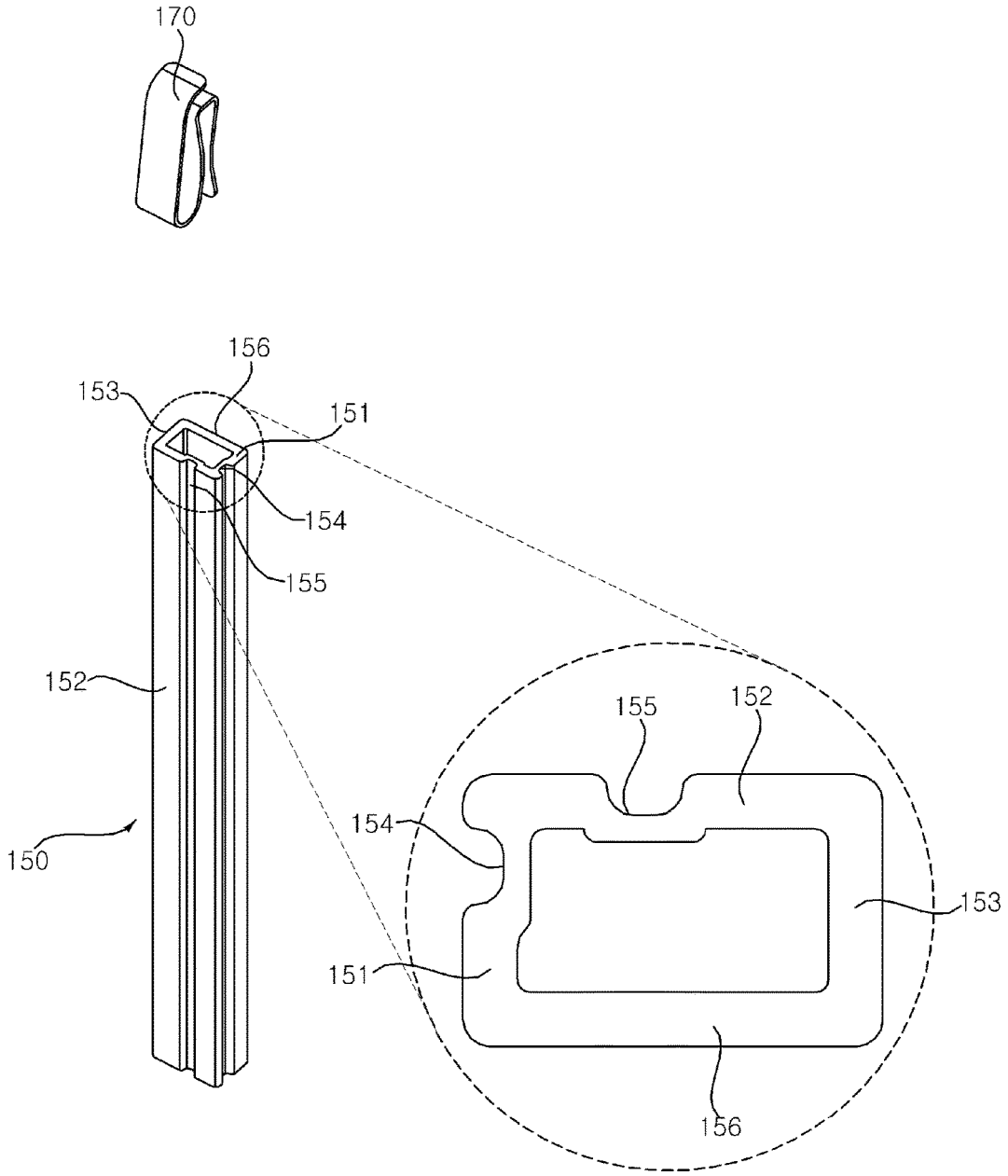
FIG. 18 is a diagram illustrating a portion of an installation kit according to an embodiment of the present disclosure.

Referring to FIG. 18, the installation kit 100 will be described below. FIG. 18 is an exploded view of the auxiliary frame 150 and the holder 170. The auxiliary frame 150 may include an auxiliary frame coupling part (or auxiliary frame coupling wall) 151, an auxiliary frame support (or auxiliary frame support wall) 152, an auxiliary frame inner surface (or auxiliary frame inner wall) 153, and a panel coupling surface (or panel coupling wall)156. The auxiliary frame coupling part 151 may extend in the vertical direction. The auxiliary frame support 152 may extend in the vertical direction. Additionally, the auxiliary frame support 152 may extend in a horizontal direction intersecting the auxiliary frame coupling part 151. The auxiliary frame inner surface 153 may be spaced apart from the auxiliary frame coupling part 151. The panel coupling surface 156 may face the front panel 110 (see FIG. 19). The holder 170 may be detached from an upper portion of the auxiliary frame 150.

The auxiliary frame 150 may include an auxiliary frame fastening groove 154. The auxiliary frame fastening groove 154 may be recessed into the auxiliary frame coupling part 151. The auxiliary frame 150 may include an auxiliary frame support groove 155. The auxiliary frame support groove 155 may be recessed into the auxiliary frame support 152.

Figure 19:
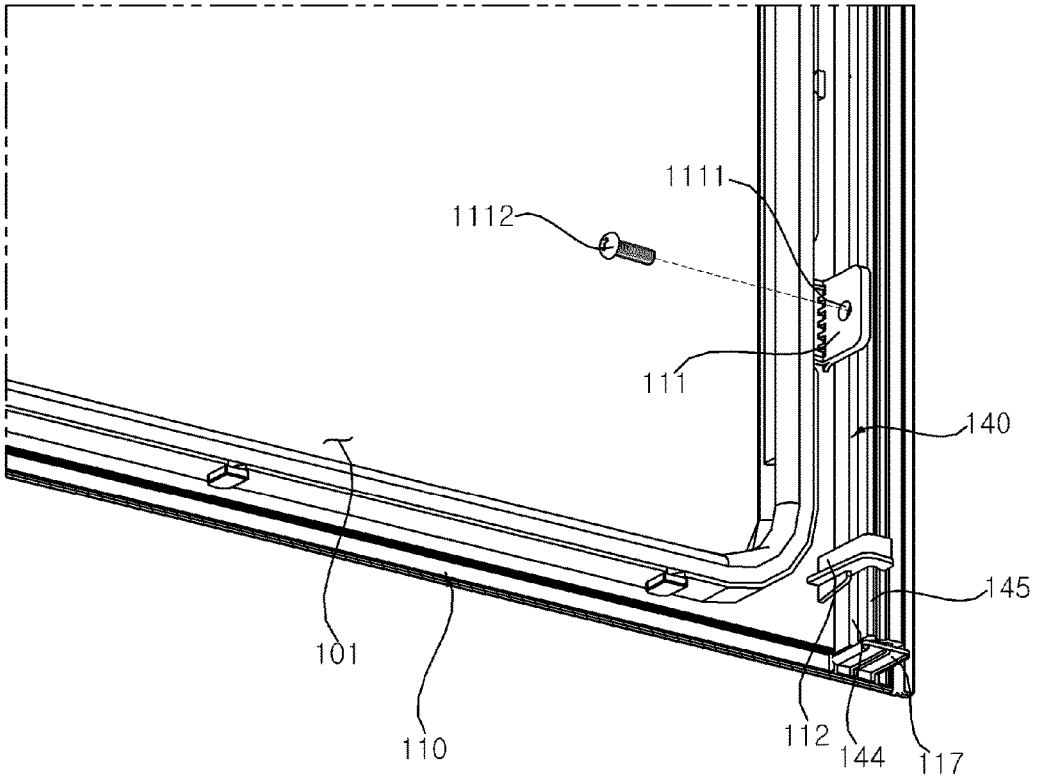
FIG. 19 is a diagram illustrating a portion of an installation kit according to an embodiment of the present disclosure.
Figure 20:
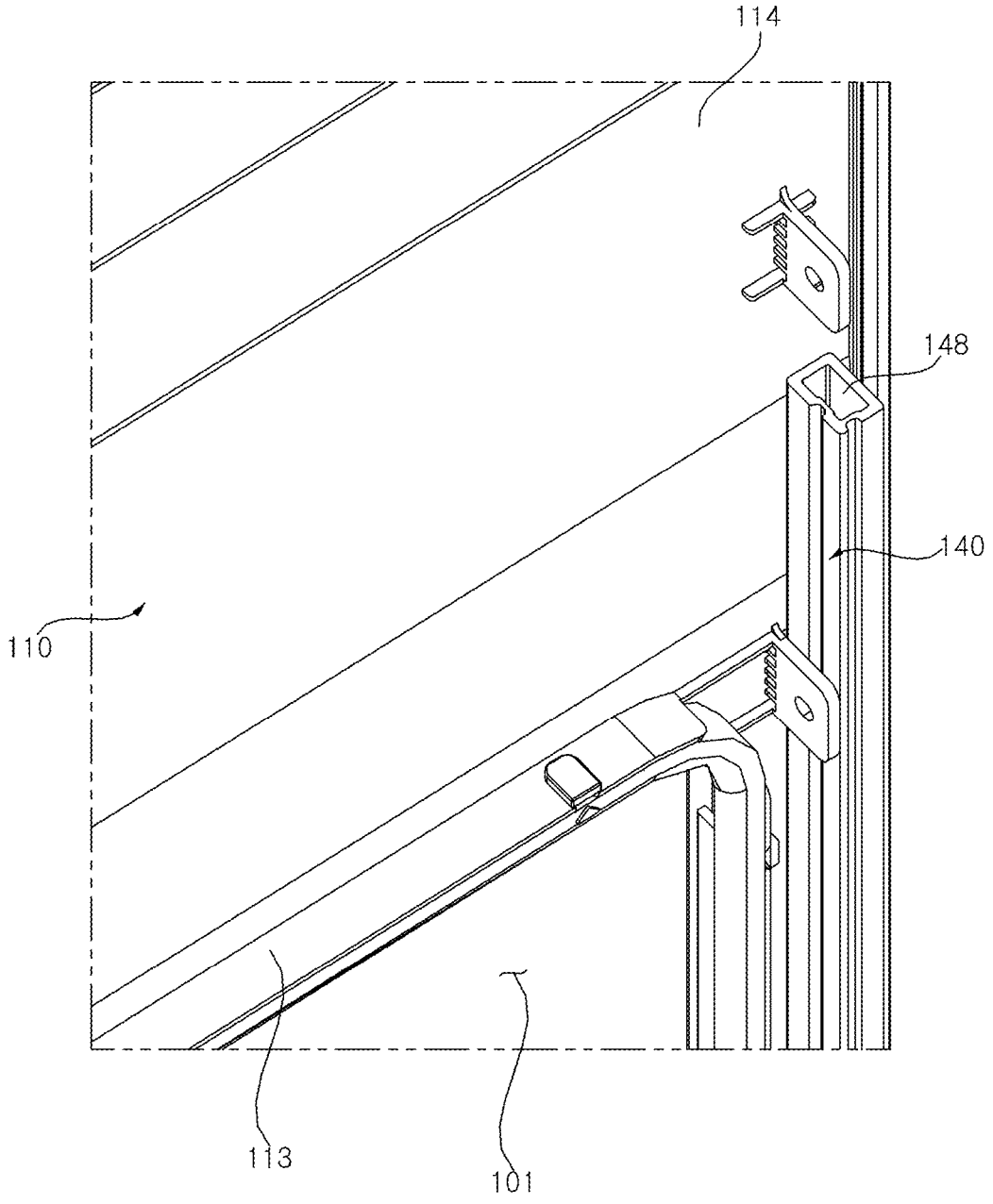
FIG. 20 is a diagram illustrating a portion of an installation kit according to an embodiment of the present disclosure.
Figure 21:
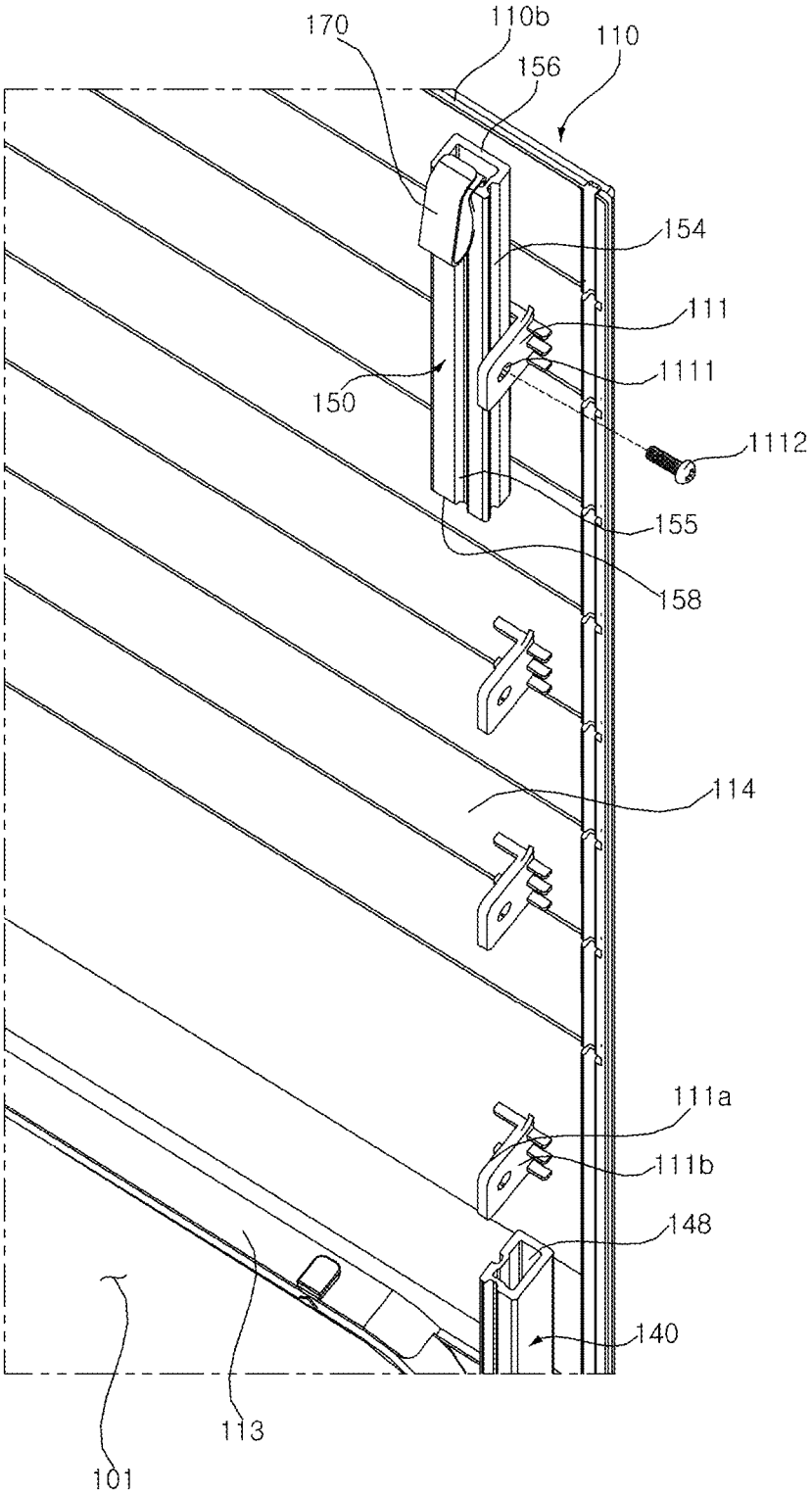
FIG. 21 is a diagram illustrating a portion of an installation kit according to an embodiment of the present disclosure.

Referring to FIGS. 19 to 21, the installation kit 100 will be described below. For example, FIG. 19 is a diagram illustrating a lower structure of the installation kit 100 when the second side frame 140 is coupled to the front panel 110, FIG. 20 is a diagram illustrating a portion of the installation kit 100 when the second side frame 140 is coupled to the front panel 110, and FIG. 21 is a diagram illustrating an upper structure of the installation kit 100 when the second side frame 140 and the auxiliary frame 150 are coupled to the front panel 110.

Referring to FIG. 19, the second side frame 140 may be seated on top of the support rib 117. The second side frame 140 may extend upward from the top of the support rib 117. A structure in which the support rib 117 is seated on the window frame 91 may correspond that described above with reference to FIG. 14. The second side frame 140 may be in close contact with the support protrusion 112. For example, the support protrusion 112 may be received in the second support groove 145. The support protrusion 112 may support the second side frame 140.

The second fastening groove 144 may face the coupling rib 111. The fastening member 1112 passes through the fastening hole 1111 and the second fastening groove 144 so that the second side frame 140 and the coupling rib 111 may be coupled to each other. The second fastening groove 144 may be recessed in a direction away from the coupling rib 111. The second fastening groove 144 may be recessed in a direction in which the fastening member 1112 is inserted.

Accordingly, the fastening member 1112 may be easily inserted into the second side frame 140.

Referring to FIG. 20, an upper end 148 (or a frame upper end 148) of the second side frame 140 may be disposed at the plate 114. The second side frame 140 may extend upward from one side of the opening 101. The second side frame 140 may include the frame upper end 148. The frame upper end 148 may be disposed above the opening 101. The frame upper end 148 may be disposed at the rear of the plate 114. The frame upper end 148 may be disposed above the gasket coupling part 113.

Referring to FIG. 21, the auxiliary frame 150 may be disposed at the panel upper end 110*b*. The above description made with reference to FIG. 16 may also apply to a connection structure between the panel upper end 110*b*, at which the auxiliary frame 150 is disposed, and the window frame 91. In this case, in the description made with reference to FIG. 16, the extension frame 130 may be replaced with the auxiliary frame 150.

The auxiliary frame 150 may be disposed above the second side frame 140. The auxiliary frame 150 may be spaced above the second side frame 140. The auxiliary frame fastening groove 154 may face the coupling rib 111. The fastening member 1112 passes through the fastening hole 1111 and the auxiliary frame fastening groove 154 so that the auxiliary frame 150 and the coupling rib 111 may be coupled to each other.

The auxiliary frame fastening groove 154 may be recessed in a direction away from the coupling rib 111. The auxiliary frame fastening groove 154 may be recessed in a direction in which the fastening member 1112 is inserted. The panel coupling surface 156 may face the front panel 110. The panel coupling surface 156 may be coupled to the front panel 110 by adhesive tape.

The auxiliary frame 150 may be disposed below the panel upper end 110*b*. The holder 170 may protrude upward from the auxiliary frame 150. The holder 170 may be disposed at the rear of the panel upper end 110*b*. The auxiliary frame 150 may include an auxiliary frame lower end 158. The auxiliary frame lower end 158 may be disposed above the frame upper end 148. The auxiliary frame lower end 158 and the frame upper end 148 may be vertically spaced apart from each other.

The coupling rib 111 may include a first coupling rib surface 111*a* and a second coupling rib surface 111*b*. The first coupling rib surface 111*a* may face the inside of the front panel 110. The second coupling rib surface 111*b* may face the outside of the front panel 110. The auxiliary frame 150 may face the first coupling rib surface 111*a*. The second side frame 140 may face the second coupling rib surface 111*b*.

In certain examples, the installation kit 100 described above with reference to FIGS. 1 to 21 may be installed in a double window, whereas the installation kit 1000 to be described below with reference to FIGS. 22 to 28 may be installed in a single window. The installation kit 100 described above with reference to FIGS. 1 to 21 may be referred to as a "first installation kit 100." The installation kit 1000 to be described below with reference to FIGS. 22 to 28 may be referred to as a "second installation kit 1000. It should be appreciated that the above description of the installation kit 100 described with reference to FIGS. 1 to 21 may also apply to corresponding components of the installation kit 1000, which will be described below with reference to FIGS. 22 to 28.

Figure 22:
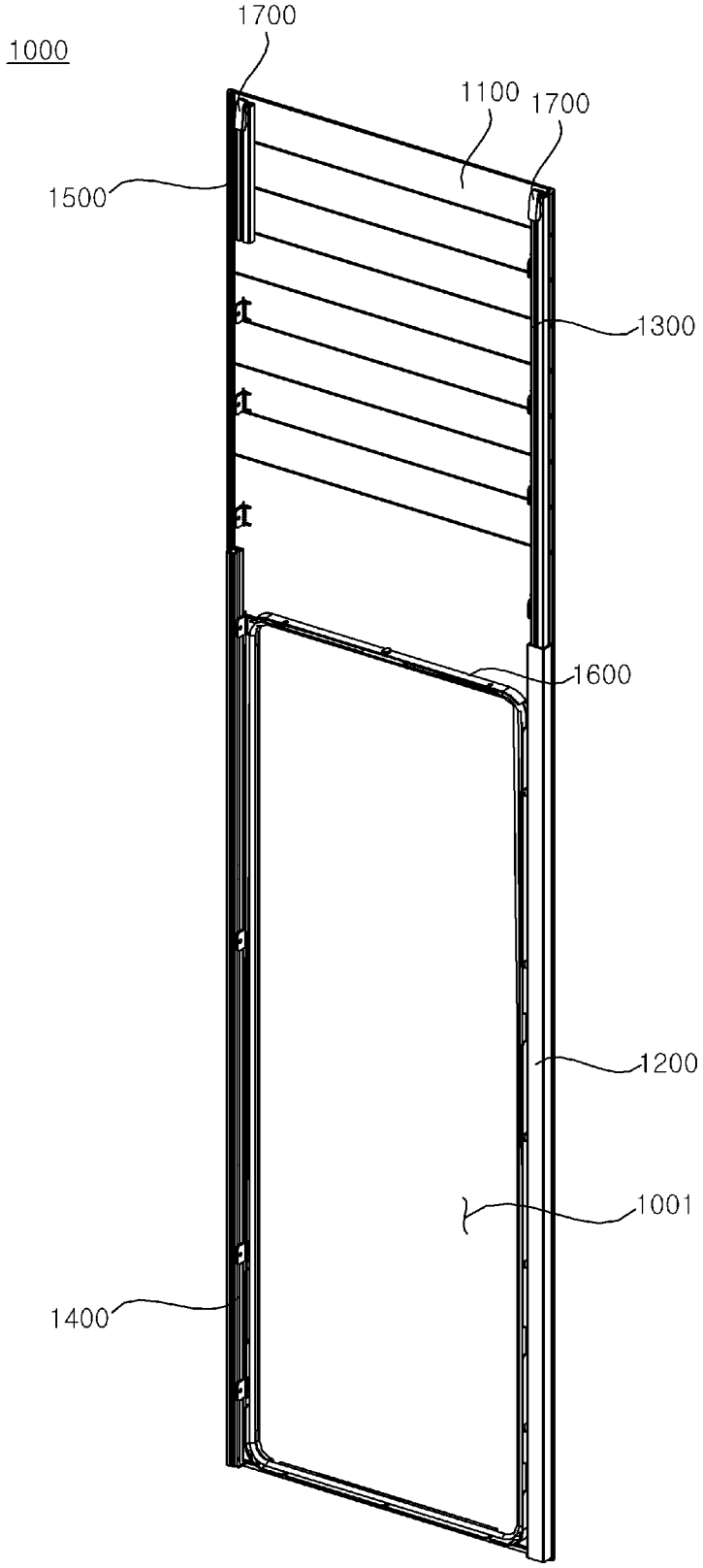
FIG. 22 is a perspective view of an installation kit according to an embodiment of the present disclosure.
Figure 23:
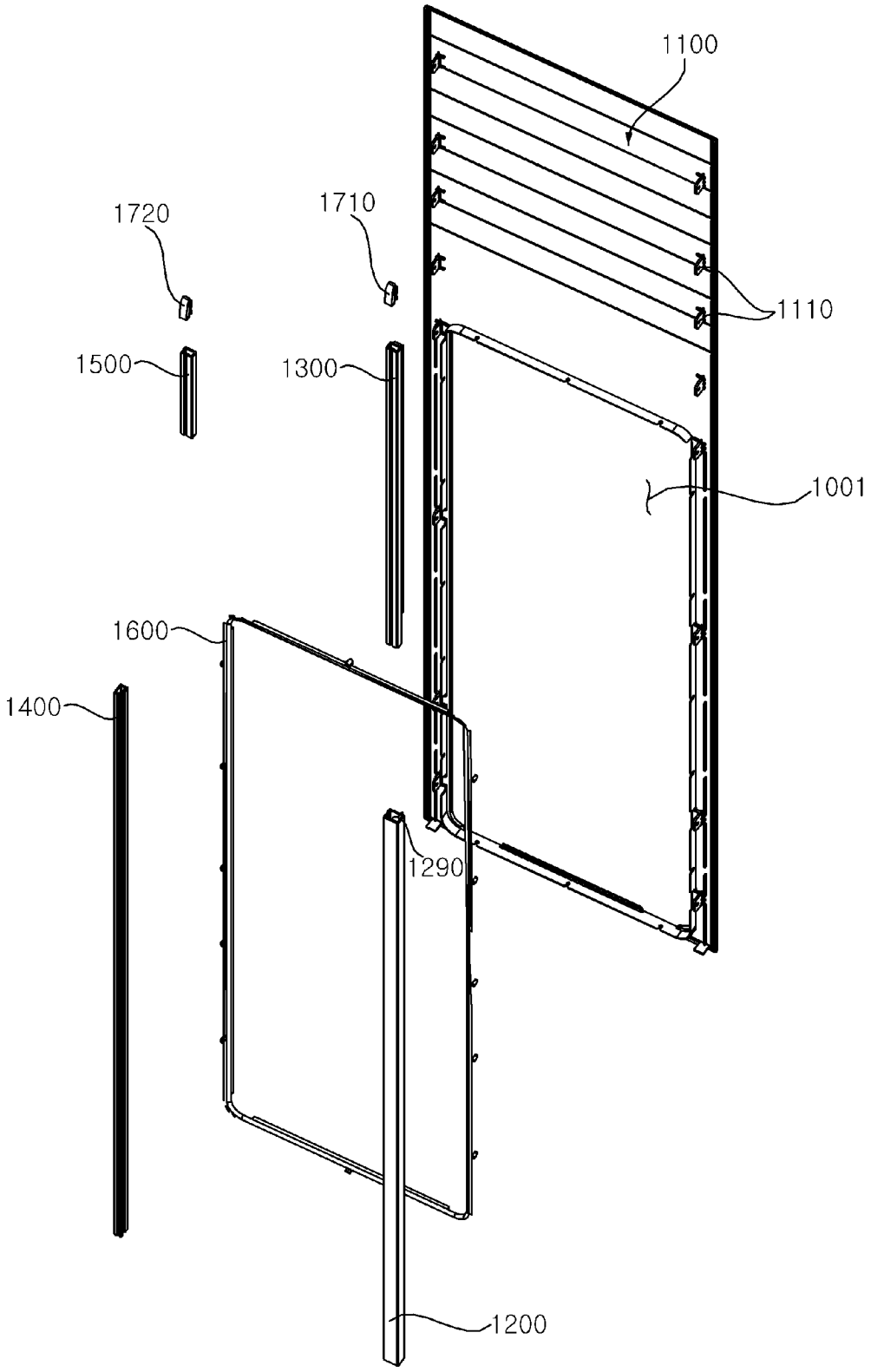
FIG. 23 is an exploded view of an installation kit according to an embodiment of the present disclosure.

Referring to FIG. 22, the installation kit 1000 will be described below, and FIG. 22 is a diagram illustrating the installation kit 1000 as viewed from the rear, according to an embodiment of the present disclosure.

The installation kit 1000 may include a front panel 1100. It should be appreciated that the above description of the front panel 110 described above with reference to FIGS. 1 to 21 may also apply to a front panel 1100 in the following description of the installation kit 1000 with reference to FIGS. 22 to 28. That is, the front panel of the installation kit 100 installed in the double window and the front panel of the installation kit 1000 installed in the single window may have a substantially same structure and shape.

The installation kit 1000 may include first side frame 1200 and an extension frame 1300. A front-to-back width of a first side frame 1200 of the second installation kit 1000 may be smaller than a front-to-back width of the first side frame 120 of the first installation kit 100. A front-to-back width of an extension frame 1300 of the second installation kit 1000 may be smaller than a front-to-back width of the extension frame 130 of the first installation kit 100.

The installation kit 1000 may include auxiliary frame 1500 and extension frame 1300. An auxiliary frame 1500 of the second installation kit 1000 may have a substantially same structure and shape as the auxiliary frame 150 of the first installation kit 100. The extension frame 1300 of the second installation kit 1000 may have a substantially same structure and shape as the second side frame 140 of the first installation kit 100. For example, the second side frame 140 of the first installation kit 100 may be used as the extension frame 1300 of the second installation kit 1000. However, in using the same frame for different installation kits 100; 1000, a surface in contact with the front panel 110 when the second side frame 140 of the first installation kit 100 is used may be different from a surface in contact with the front panel 1100 when the extension frame 1300 of the second installation kit 1000 is used.

The installation kit 1000 may include second side frame 1400. A second side frame 1400 of the second installation kit 1000 may have a substantially same structure and shape as the second side frame 140 of the first installation kit 100. That is, the second side frame 140 of the first installation kit 100 may be used as the second side frame 1400 of the second installation kit 1000. Thus, second side frame 1400 and extension frame 1300 may have a common structure and shape. However, in using the same frame for different installation kits 100; 1000, a surface in contact with the front panel 110 when the second side frame 140 of the first installation kit 100 is used may be different from a surface in contact with the front panel 1100 when the second side frame 1400 of the second installation kit 1000 is used.

An auxiliary frame 1500 of the second installation kit 1000 may have the same structure and shape as the auxiliary frame 150 of the first installation kit 100. That is, the auxiliary frame 150 of the first installation kit 100 may be used as the auxiliary frame 1500 of the second installation kit 1000. However, in using the same frame for different installation kits 100; 1000, a surface in contact with the front panel 110 when the auxiliary frame 150 of the first installation kit 100 is used may be different from a surface in contact with the front panel 1100 when the auxiliary frame 1500 of the second installation kit 1000 is used.

As previously described, the installation kit 1000 may include the front panel 1100. The front panel 1100 may be disposed to surround the case front end 13 (see FIG. 1) of the air conditioner 1 in the first space 93 (see FIG. 2) or the second space (see FIG. 2). The installation kit 1000 may have an opening 1001. The case 10 of the air conditioner 1 may pass through the opening 1001. The case 10 may be supported by the installation kit 1000 in the opening 1001. The opening 1001 may be formed in the front panel 1100.

The installation kit 1000 may include the first side frame 1200. The first side frame 1200 may be detached from the front panel 1100. The first side frame 1200 may be disposed behind the front panel 1100. The first side frame 1200 may extend in the vertical direction. A vertical length of the first side frame 1200 may be smaller than a vertical length of the front panel 1100.

The installation kit 1000 may include the extension frame 1300. The extension frame 1300 may be detached from the front panel 1100. The extension frame 1300 may be disposed behind the front panel 1100. The extension frame 1300 may extend in the vertical direction. A vertical length of the extension frame 1300 may be smaller than the vertical length of the front panel 1100. The extension frame 1300 may be coupled to the first side frame 1200 so as to be movable in the vertical direction.

The installation kit 1000 may include the second side frame 1400. The second side frame 1400 may be detached from the front panel 1100. The second side frame 1400 may be disposed behind the front panel 1100. The second side frame 1400 may extend in the vertical direction. A vertical length of the second side frame 1400 may be smaller than the vertical length of the front panel 1100.

The first side frame 1200 and the second side frame 1400 may be horizontally spaced apart from each other. The opening 1001 may be formed between the first side frame 1200 and the second side frame 1400. The first side frame 1200 may be disposed to face the window 92 (see FIG. 1). The second side frame 1400 may be disposed to face the window frame 91 (see FIG. 1). The extension frame 1300 is positioned vertically above first side frame 1200 and may also be disposed to face the window 92 (see FIG. 1).

The installation kit 1000 may include the auxiliary frame 1500. The auxiliary frame 1500 may be detached from the front panel 1100. The auxiliary frame 1500 may be disposed behind the front panel 1100. The auxiliary frame 1500 may extend in the vertical direction. A vertical length of the auxiliary frame 1500 may be smaller than the vertical length of the second side frame 1400. The auxiliary frame 1500 may be spaced above the second side frame 1400. The auxiliary frame 1500 may be horizontally spaced apart from the extension frame 1300. The auxiliary frame 1500 may be disposed at an upper end of the front panel 1100.

The installation kit 1000 may include an inner gasket 1600. The inner gasket 1600 may be disposed to surround the opening 1001. The inner gasket 1600 may be disposed to surround the case 10 (see FIG. 1). The inner gasket 1600 may be disposed between the case 10 and the installation kit 1000. The inner gasket 1600 may seal a space between the case 10 (see FIG. 1) and the front panel 1100.

The installation kit 1000 may include a holder 1700. A plurality of holders 1700 may be arranged to be horizontally spaced apart from each other. The holders 1700 may be coupled to the extension frame 1300. The holders 1700 may be coupled to the auxiliary frame 1500. The holders 1700 may protrude upward from the extension frame 1300. The holders 1700 may protrude upward from the auxiliary frame 1500. The holders 1700 may protrude above the upper end of the front panel 1100. The holders 1700 may be fixed to the upper support 911 of the window frame 91 (see FIG. 1). The holders 1700 may serve to fix the installation kit 1000 to the window frame 91.

The first side frame 1200 and the extension frame 1300 may face the window 92 (see FIG. 1). A separate gasket (not shown) may be disposed in a space between the first side frame 1200 and the window 92 and a space between the extension frame 1300 and the window 92.

The second side frame 1400 may face the window frame 91 (see FIG. 1). The second side frame 1400 may face the side support 913 (see FIG. 1) of the window frame 91. The second side frame 1400 may contact the side support 913. However, a separate gasket (not shown) may be disposed between the second side frame 1400 and the side support 913.

Figure 24:
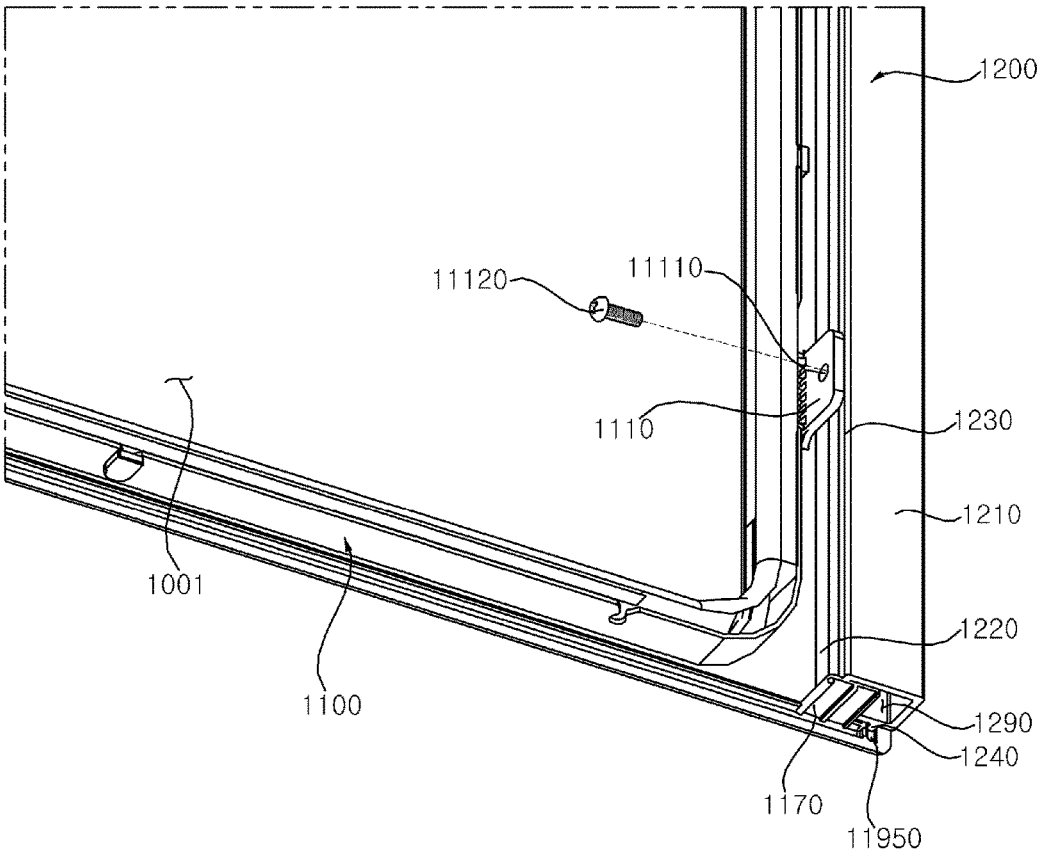
FIG. 24 is a diagram illustrating a portion of an installation kit according to an embodiment of the present disclosure.

Referring to FIG. 24, the installation kit 1000 will be described below. FIG. 24 is an exploded view of the installation kit 1000. The front panel 1100 may include coupling ribs 1110. A plurality of coupling ribs 1110 may be arranged to be vertically spaced apart from each other. The coupling ribs 1110 may protrude rearward from the front panel 1100. The coupling ribs 1110 may be formed on both sides of the front panel 1100.

The first side frame 1200 may be detached from the front panel 1100. The first side frame 1200 may be coupled to the coupling ribs 1110 via a fastening member 11120 (see FIG. 24). The second side frame 1400 may be detached from the front panel 1100. The second side frame 1400 may be coupled to the coupling ribs 1110 via the fastening member 11120 (see FIG. 27).

The extension frame 1300 may be detached from the front panel 1100. The extension frame 1300 may be coupled to the coupling ribs 1110 via the fastening member 11120 (see FIG. 26). The first side frame 1200 may include an extension frame insertion part 1290. The extension frame 1300 may be disposed in the extension frame insertion part 1290 so as to be movable in the vertical direction. The extension frame 1300 may move in the extension frame insertion part 1290 to protrude upward from the first side frame 1200.

The auxiliary frame 1500 may be detached from the front panel 1100. The auxiliary frame 1500 may be coupled to the coupling ribs 1110 via the fastening member 11120 (see FIG. 28).

The holders (or clips) 1700 may include a first holder 1710. The first holder 1710 may be coupled to the extension frame 1300. The holders 1700 may include a second holder 1720. The second holder 1720 may be coupled to the auxiliary frame 1500.

Figure 25:
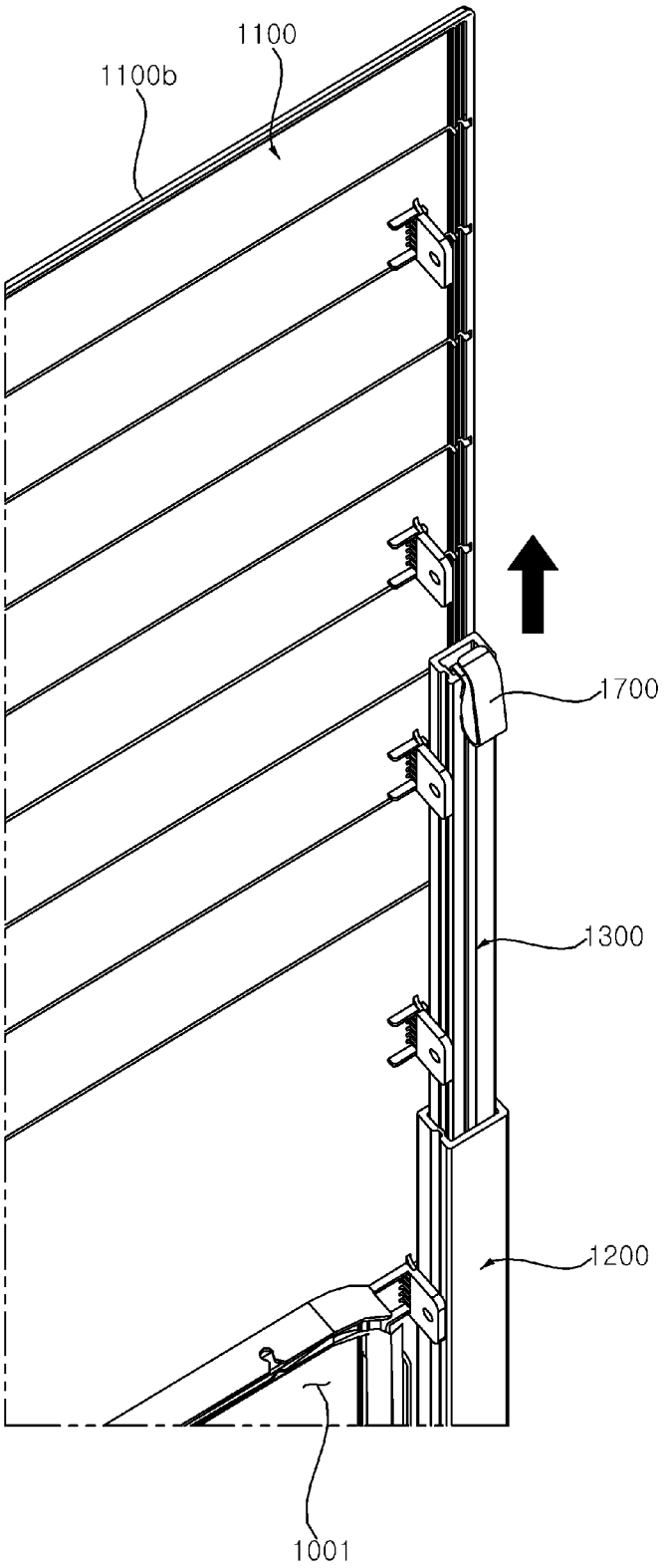
FIG. 25 is a diagram illustrating a portion of an installation kit according to an embodiment of the present disclosure.
Figure 26:
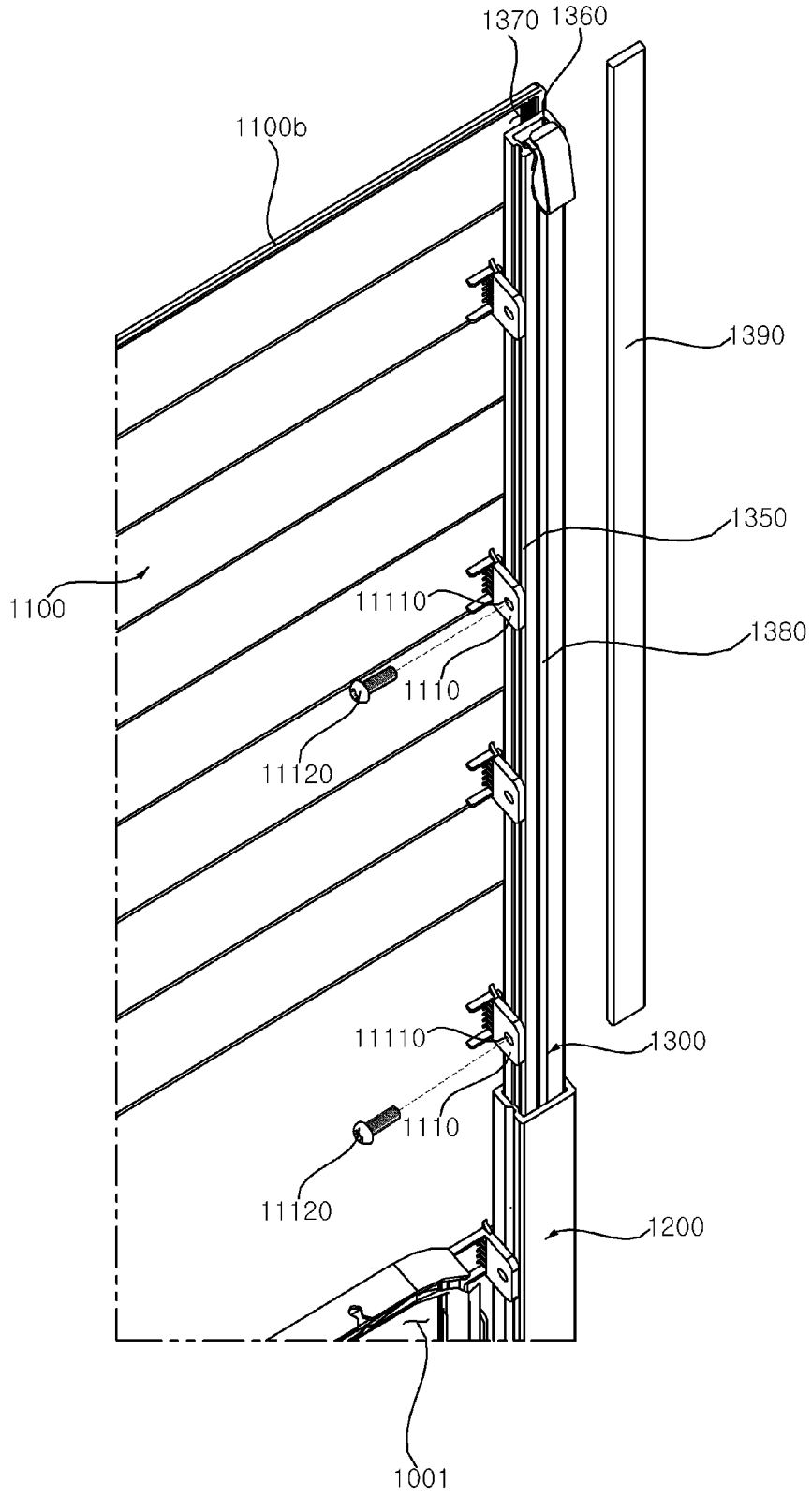
FIG. 26 is a diagram illustrating a portion of an installation kit according to an embodiment of the present disclosure.

Referring to FIGS. 24 and 26, the installation kit 1000 will be described below. FIG. 24 is a diagram illustrating a lower structure of the installation kit 1000 when the first side frame 1200 is coupled to the front panel 1100. FIG. 25 is a diagram illustrating an upper structure of the installation kit 1000 when the first side frame 1200 and the extension frame 1300 are coupled to the front panel 1100. FIG. 26 is a diagram illustrating the installation kit 1000 after the extension frame 1300 is raised.

Referring to FIG. 24, the first side frame 1200 may be coupled to the front panel 1100. A support rib 1170 may be disposed on the window frame 91. The above description made with reference to FIG. 14 may also apply to a connection structure between the lower portion of the front panel 1100 and the window frame 91. The first side frame 1200 may be disposed on the support rib 1170. The first side frame 1200 may extend upward from an upper side of the support rib 1170.

The first side frame 1200 may include a first body 1210. The first body 1210 may extend in the vertical direction, and the extension frame insertion part 1290 may be formed inside the first body 1210. The first side frame 1200 may include a guide protrusion 1240, and the guide protrusion 1240 may protrude from the first body 1210.

The front panel 1100 may include a guide groove 11950. The guide groove 11950 may extend in the vertical direction. The guide protrusion 1240 may be inserted into the guide groove 11950. A structure in which the guide protrusion 1240 is inserted into the guide groove 11950 may guide the first side frame 1200 to be disposed on the front panel 1100.

The first side frame 1200 may include a first frame coupling part 1220. The first frame coupling part 1220 may form one side surface of the first body 1210. The first side frame 1200 may include a first fastening groove 1230. The first fastening groove 1230 may be recessed into the first frame coupling part 1220.

The first frame coupling part 1220 may be coupled to the front panel 1100. The first fastening groove 1230 may face the coupling rib 1110. The coupling rib 1110 may include a fastening hole 11110. The installation kit 1000 may include the fastening member 11120. The fastening member 11120 may pass through the fastening hole 11110 and the first fastening groove 1230. The fastening member 11120 may allow the fastening rib 1110 and the first side frame 1200 to be coupled to each other.

The first fastening groove 1230 may be recessed in a direction away from the coupling rib 1110. The first fastening groove 1230 may be recessed in a direction in which the fastening member 11120 is inserted. Accordingly, the fastening member 11120 may be easily inserted into the first frame coupling part 1220.

Referring to FIG. 25, the extension frame 1300 may move upward from the first side frame 120. The front panel 1100 may include a panel upper end 1100*b*. The panel upper end 1100*b* may form an upper surface of the front panel 110. The first side frame 1200 may be spaced below the panel upper end 1100*b*. The extension frame 1300 may move toward the panel upper end 1100*b* from the first side frame 1200. The holder 1700 may move toward the panel upper end 1100*b* along with the extension frame 1300.

Referring to FIG. 26, the extension frame 1300 may be disposed at the panel upper end 1100*b*. An upper portion of the front panel 1100 may be coupled to the window frame 91. The above description made with reference to FIG. 16 may also apply to the connection structure between the front panel 1100 may be inserted into the window frame 91.

The extension frame 1300 may include an extension frame fastening groove 1350. The extension frame fastening groove 1350 may extend in the vertical direction. The extension frame fastening groove 1350 may face the coupling ribs 1110. The fastening member 11120 passes through the fastening hole 11110 and the extension frame fastening groove 1350 so that the extension frame 1300 and the coupling rib 1110 may be coupled to each other.

The extension frame 1300 may include a finishing member coupling part 1360. The finishing member coupling part 1360 may face the front panel 1100. The extension frame 1300 may include an extension frame support groove 1380. The extension frame support groove 1380 may extend in the vertical direction. The extension frame 1300 may include a finishing member 1390. The finishing member 1390 may extend in the vertical direction. The finishing member 1390 may be detached from the extension frame 1300.

The finishing member coupling part 1360 may be spaced apart from the front panel 1100. A gap 1370 may be formed between the finishing member coupling part 1360 and the front panel 1100. The finishing member 1390 is inserted into the gap 1370, to be coupled to the extension frame 1300 and the front panel 1100. The finishing member 1390 may be attached to the extension frame 1300 by adhesive tape. The finishing member 1390 may be attached to the front panel 1100 by adhesive tape.

Figure 27:
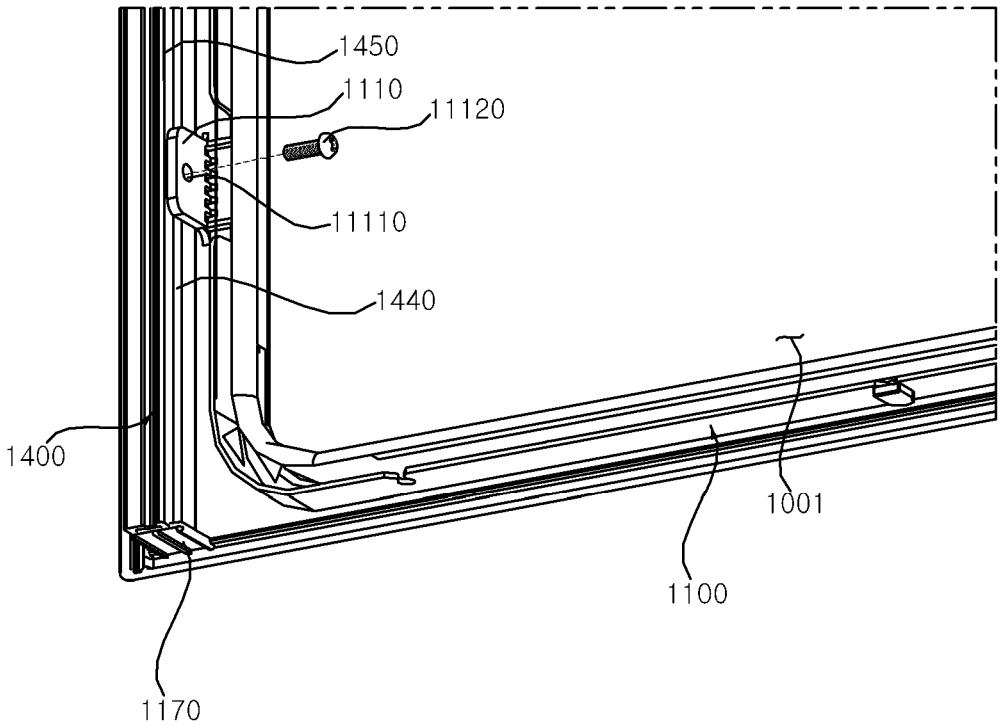
FIG. 27 is a diagram illustrating a portion of an installation kit according to an embodiment of the present disclosure.
Figure 28:
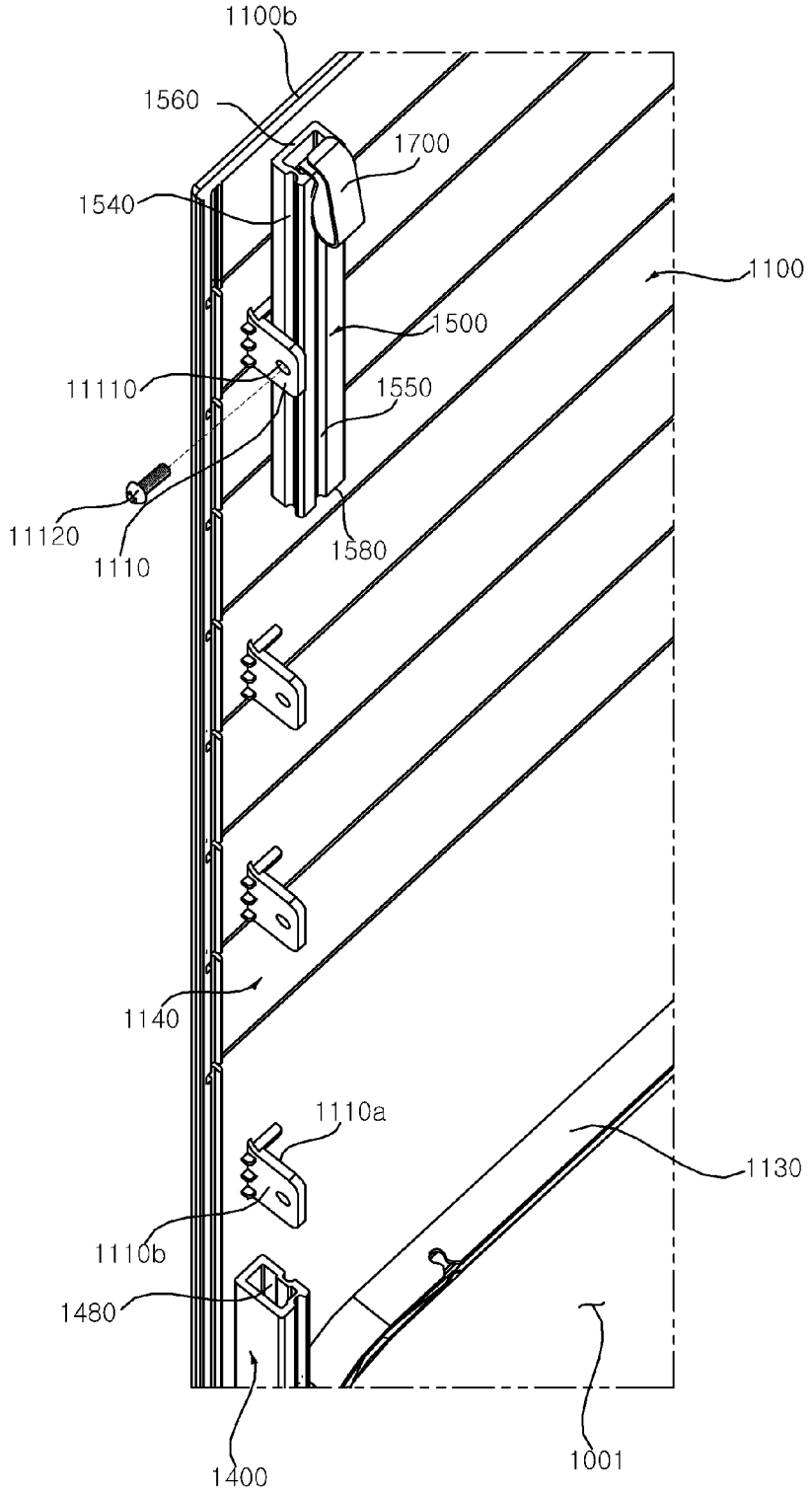
FIG. 28 is a diagram illustrating a portion of an installation kit according to an embodiment of the present disclosure.

Referring to FIGS. 27 and 28, the installation kit 1000 will be described below. FIG. 27 is a diagram illustrating a lower structure of the installation kit 1000 when the second side frame 1400 is coupled to the front panel 1100. FIG. 28 is a diagram illustrating an upper structure of the installation kit 1000 when the second side frame 1400 and the auxiliary frame 1500 are coupled to the front panel 1100.

Referring to FIG. 27, the second side frame 1400 may be seated on top of the support rib 1170. The second side frame 1400 may extend upward from the top of the support rib 1170. The second side frame 1400 may include a second fastening groove 1440. The second fastening groove 1440 may extend in the vertical direction. The second side frame 1400 may include a second support groove 1450. The second support groove 1450 may extend in the vertical direction.

The second fastening groove 1440 may face the coupling rib 1110. The fastening member 11120 passes through the fastening hole 11110 and the second fastening groove 1440 so that the second side frame 1400 and the coupling rib 1110 may be coupled to each other. The second fastening groove 1440 may be recessed in a direction away from the coupling rib 1110. The second fastening groove 1440 may be recessed in a direction in which the fastening member 11120 is inserted. Accordingly, the fastening member 11120 may be easily inserted into the second side frame 1400.

Referring to FIG. 28, the auxiliary frame 1500 may be disposed at the panel upper end 1100*b*, and an upper end 1480 (or a frame upper end 1480) of the second side frame 1400 may be disposed at the plate 1140. The second side frame 1400 may extend upward from one side of the opening 1001. The second side frame 1400 may include the frame upper end 1480. The frame upper end 1480 may be disposed above the opening 1001. The frame upper end 1480 may be disposed at the rear of the plate 1140. The frame upper end 1480 may be disposed above the gasket coupling part 1130.

The auxiliary frame 1500 may be disposed above the second side frame 1400. The auxiliary frame 1500 may be spaced above the second side frame 1400. The auxiliary frame 1500 may include an auxiliary frame fastening groove 1540. The auxiliary frame fastening groove 1540 may extend in the vertical direction. The auxiliary frame 1500 may include an auxiliary frame support groove 1550. The auxiliary frame support groove 1550 may extend in the vertical direction.

The auxiliary frame fastening groove 1540 may face the coupling rib 1110. The fastening member 11120 passes through the fastening hole 11110 and the auxiliary frame fastening groove 1540 so that the auxiliary frame 1500 and the coupling rib 1110 may be coupled to each other. The auxiliary frame fastening groove 1540 may be recessed in a direction away from the coupling rib 1110. The auxiliary frame fastening groove 1540 may be recessed in a direction in which the fastening member 11120 is inserted.

The auxiliary frame 150 may include a panel coupling surface 1560. The panel coupling surface 1560 may extend in the vertical direction. The panel coupling surface 1560 may face the front panel 1100. The panel coupling surface 1560 may be coupled to the front panel 1100 by adhesive tape. The auxiliary frame 1500 may be disposed below the panel upper end 1100*b*. The holder 1700 may protrude upward from the auxiliary frame 1500. The holder 1700 may be disposed at the rear of the panel upper end 1100*b*.

The auxiliary frame 1500 may include an auxiliary frame lower end 1580. The auxiliary frame lower end 1580 may be disposed above the frame upper end 1480. The auxiliary frame lower end 1580 and the frame upper end 1480 may be vertically spaced apart from each other.

The coupling rib 1110 may include a first coupling rib surface 1110*a* and a second coupling rib surface 1110*b*. The first coupling rib surface 1110*a* may face the inside of the front panel 1100. The second coupling rib surface 1110*b* may face the outside of the front panel 1100. The auxiliary frame 1500 may face the first coupling rib surface 1110*a*. The second side frame 1400 may face the second coupling rib surface 1110*b*.

An aspect of the present disclosure to facilitate installation of an air conditioner in a window. It is yet another aspect of the present disclosure to provide an installation kit that supports an air conditioner. It is yet another aspect of the present disclosure to simplify a structure of an installation kit. It is yet another aspect of the present disclosure to facilitate installation of an installation kit. It is yet another aspect of the present disclosure to adjust height of an installation kit. It is yet another aspect of the present disclosure to simplify a process of adjusting height of an installation kit. It is yet another aspect of the present disclosure to reduce noise and vibration of an air conditioner. It is yet another aspect of the present disclosure to prevent damage to an air conditioner caused by a window frame and a window. It is yet another aspect of the present disclosure to prevent entry of water, generated in an air conditioner, or rainwater into an indoor space. It is yet another aspect of the present disclosure to improve the appearance of a window-mounted air conditioner. It is yet another aspect of the present disclosure to simplify assembly of an installation kit. It is yet another aspect of the present disclosure to reduce the number of components. The aspects of the present disclosure are not limited to the aforementioned aspects and other aspects not described herein will be clearly understood by those skilled in the art from the following description.

In accordance with an aspect of the present disclosure, the above and other objectives can be accomplished by providing an installation kit including a front panel having an opening, into which an air conditioner disposed between a window frame and a window is inserted. The front panel may extend vertically to be coupled to the window frame on an indoor side of a space in which the air conditioner is disposed.

The front panel may include a plate coupled to the window frame and extending vertically. The front panel may include a plurality of cutting plates arranged vertically and disposed to be detachable from the plate.

The front panel may include a cutting groove recessed into the plate and formed between the plurality of cutting plates, in which by cutting the cutting plates, a height of the front panel may be easily adjusted. Among the plurality of cutting plates, a cutting plate located at an uppermost position may form an upper end of the front panel and may be coupled to the window frame.

The installation kit may include a side frame coupled to the front panel. The front panel may include a coupling rib protruding rearward from the plate. The cutting groove may include a first inclined surface inclined vertically. The cutting groove may include a second inclined surface inclined vertically and disposed under the first inclined surface. The cutting groove may include a cut surface connecting the first inclined surface and the second inclined surface.

The front panel may include an edge forming a side surface of the front panel. The cutting groove may include an edge groove formed by cutting the edge. The front panel may include a reinforcement rib extending vertically. The cutting groove may include a rib groove formed by cutting the reinforcement rib. The cutting groove may include a connection groove recessed between the edge and the reinforcement rib.

The installation kit may include an extension frame disposed so as to be movable vertically with respect to the side frame. The extension frame may move upward from the side frame to extend toward an upper portion of the front panel.

The front panel may include a coupling rib facing the side frame. The installation kit may include a fastening member coupling the front panel and the side frame. The side frame may include a fastening groove recessed in a direction in which the fastening member is inserted. The extension frame may include an extension frame fastening groove recessed in a direction in which the fastening member is inserted.

The front panel may include a support rib seated on top of the window frame. The support rib may be disposed above a lower end of the front panel. The side frame may be seated on top of the support rib. The front panel may include a support protrusion bent and extending toward the side frame. The side frame may include a support groove into which the support protrusion is inserted.

The front panel may include a guide groove recessed in a rear surface of the front panel. The side frame may include a guide protrusion inserted into the guide groove.

The installation kit may include a finishing member disposed between the extension frame and the front panel. The finishing member may be inserted into a gap formed between the extension frame and the front panel.

According to at least one embodiment of the present disclosure, an air conditioner may be stably supported by an installation kit. According to at least one embodiment of the present disclosure, by facilitating coupling between an installation kit and a window frame or a window, the air conditioner may be simply installed. According to at least one embodiment of the present disclosure, by providing a side frame which is detachable from a front panel, an installation kit may be easily assembled. According to at least one embodiment of the present disclosure, by providing a structure in which a portion of a front panel is cut, the height of an installation kit may be easily adjusted. According to at least one embodiment of the present disclosure, by providing a sliding structure of a side frame, the height of an installation kit may be easily adjusted. According to at least one embodiment of the present disclosure, an installation kit is provided at the front of an air conditioner, thereby reducing noise and vibration generated by the air conditioner.

According to at least one embodiment of the present disclosure, a side frame is provided between a window and an air conditioner, thereby preventing damage to the air conditioner caused by the window. According to at least one embodiment of the present disclosure, an installation kit is disposed at the front of an air conditioner, thereby preventing entry of water, generated in an air conditioner, or rainwater entering from the outside, into an indoor space. According to at least one embodiment of the present disclosure, a case of an air conditioner and an installation kit are made of the same material, thereby improving the appearance. According to at least one embodiment of the present disclosure, first and second side frames are detachable from both sides of a front panel, such that coupling positions of the first and second side frames may be easily adjusted. According to at least one embodiment of the present disclosure, by switching positions of first and second side frames that are coupled to a front panel, an installation kit may be easily installed at various positions of a window. According to at least one embodiment of the present disclosure, the shape and structure of side frames and a front panel may facilitate assembly of the side frames and the front panel.

The aspects of the present disclosure are not limited to the aforesaid, and other effects not described herein will be clearly understood by those skilled in the art from the following description of the appended claims.

While the preferred embodiments have been particularly shown and described, the present specification shall not be limited to the particular embodiments described above, and it will be understood by an ordinary skilled person in the art that various changes in form and details may be made therein without departing from the spirit and scope of the present invention as defined by the following claims, and the alternative embodiments should not be individually understood from the inventive concept and prospect of the present disclosure.

It will be apparent to those skilled in the art that various modifications and variations can be made in the present disclosure, and thus, the present disclosure should not be construed as being limited to the aforementioned embodiments. Therefore, it is intended that the present disclosure cover the modifications and variations of this disclosure provided they come within the scope of the appended claims and their equivalents.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An installation kit comprising:

a front panel having an opening configured to receive a portion of the an air conditioner positioned in a space between a window frame and a window, the front panel extending vertically to be coupled to the window frame on an indoor side of the space, wherein the front panel includes:

a plate extending vertically and configured to be coupled to the window frame; and a cutting groove recessed into the plate to define a plurality of cutting plate regions that are arranged vertically and are configured to be detachable from the plate to adjust a vertical height of the plate, the cutting groove being formed between the plurality of cutting plate regions.

2. The installation kit of claim 1, wherein an uppermost one of the plurality of cutting plates regions forms an upper end of the front panel and is configured to be coupled to the window frame.

3. The installation kit of claim 1, wherein the front panel includes a plurality of the cutting grooves that are provided between the plurality of cutting plates regions and are vertically spaced apart from each other.

4. The installation kit of claim 1, wherein a vertical height of the front panel is reduced by a length of one of the plurality of cutting plate regions when the one of the plurality of cutting plate regions is separated from the plate.

5. The installation kit of claim 1, further comprising a side frame coupled to the front panel, wherein the front panel includes a coupling rib protruding rearward from the plate.

6. The installation kit of claim 1, wherein the cutting groove includes:

a first inclined surface inclined relative to a vertical direction;

a second inclined surface inclined relative to a vertical direction and positioned under the first inclined surface; and a cut surface connecting the first inclined surface and the second inclined surface.

7. The installation kit of claim 1, wherein the front panel comprises an edge forming a side surface of the front panel, and wherein the cutting groove includes an edge groove recessed at the edge.

8. The installation kit of claim 1, wherein the front panel includes a reinforcement rib protruding rearward from the plate and extending vertically, and wherein the cutting groove comprises a rib groove recessed at the reinforcement rib.

9. The installation kit of claim 1, wherein the front panel includes:

an edge forming a side surface of the front panel; and a reinforcement rib spaced apart from the edge, and wherein the cutting groove comprises a connection groove recessed between the edge and the reinforcement rib.

10. The installation kit of claim 1, wherein the front panel includes a panel side surface spaced outside of the cutting groove.

11. An installation kit comprising:

a front panel that covers an indoor side of a space in which an air conditioner is positioned between a window frame and a window, wherein the front panel includes:

an opening into which the air conditioner is inserted; and a plate extending vertically from one side of the opening, and having an end that is positioned in front of a front end of the window frame.

12. The installation kit of claim 11, wherein the front panel includes a panel upper end positioned in front of an upper region of the front end of the window frame.

13. The installation kit of claim 12, further comprising:

a side frame coupled to the front panel; and an extension frame extending from the side frame and toward the panel upper end, wherein the extension frame is positioned below the front end of the window frame, and the panel upper end is positioned above the extension frame.

14. The installation kit of claim 11, further comprising:

a side frame coupled to the front panel;

an extension frame extending from the side frame toward an upper end of the front panel, and positioned below the front end of the window frame; and a clip protruding upward from the extension frame and hung on an upper end of the window frame.

15. The installation kit of claim 11, wherein the front panel includes a panel lower end that is positioned under the opening and in front of a lower region of the front end of the window frame.

16. The installation kit of claim 15, wherein the front panel includes a support rib protruding rearward from the panel lower end, and seated over a portion of the front end of the window frame.

17. The installation kit of claim 15, wherein the front panel includes:

a panel lower end that is positioned in front of the front end of the window frame; and a support rib provided above a bottom of the panel lower end and seated on top of the front end of the window frame.

18. The installation kit of claim 11, wherein the front panel includes:

a cutting groove recessed into the plate and defining plurality of cutting plate regions arranged vertically and configured to be detachable from the plate.

19. The installation kit of claim 18, wherein the cutting groove includes an inclined surface having an inclination angle ranging from 60 degrees to 90 degrees relative to a vertical direction.

20. The installation kit of claim 18, wherein the cutting groove has a front-to-back width of 1.5 mm to 3 mm.

21. The installation kit of claim 18, wherein the cutting groove is spaced apart from a side surface of the front panel by a gap of 1.2 mm to 3 mm.

* * * * *